US006142619A

United States Patent [19]

Miura et al.

[11] Patent Number: 6,142,619

[45] **Date of Patent: *Nov. 7, 2000**

[54] APPARATUS AND METHOD FOR MANUFACTURING INK JET PRINTED PRODUCTS AND INK JET PRINTED PRODUCTS MANUFACTURED USING THE METHOD

[75] Inventors: Yasushi Miura; Yoshiko Miyashita, both of Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/702,859

[22] Filed: Aug. 26, 1996

Related U.S. Application Data

[63] Continuation of application No. 08/093,622, Jul. 20, 1993, abandoned.

[30] Foreign Application Priority Data

| | | | |
|---|---|---|---|
| Dec. 4, 1992 | [JP] | Japan | 4-325559 |
| Jan. 18, 1993 | [JP] | Japan | 5-005972 |
| Jul. 2, 1993 | [JP] | Japan | 5-164578 |

[51] Int. Cl.[7] ..... B41J 2/01; D06P 5/00

[52] U.S. Cl. ..... 347/101; 347/102; 347/104; 347/106; 8/499

[58] Field of Search ..... 347/4, 43, 101, 347/102, 105, 106; 8/445, 499

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,561,789 | 12/1985 | Saito | 347/102 |
| 4,698,642 | 10/1987 | Gamblin | 347/105 X |
| 4,723,129 | 2/1988 | Endo et al. | 347/56 |
| 4,740,796 | 4/1988 | Endo et al. | 347/56 |
| 4,797,687 | 1/1989 | Holder et al. | 347/2 X |
| 5,250,121 | 10/1993 | Yamamoto et al. | 442/153 |
| 5,381,166 | 1/1995 | Lam et al. | 346/140.1 |
| 5,396,275 | 3/1995 | Koike et al. | 347/101 |

FOREIGN PATENT DOCUMENTS

| | | | |
|---|---|---|---|
| 0476860 | 3/1992 | European Pat. Off. . | |
| 0516366 | 12/1992 | European Pat. Off. . | |
| 59-123670 | 7/1984 | Japan . | |
| 59-138461 | 8/1984 | Japan . | |
| 61-283557 | 12/1986 | Japan | 347/19 |
| 62-053492 | 3/1987 | Japan . | |
| 62-057750 | 3/1987 | Japan . | |
| 63-031594 | 6/1988 | Japan . | |
| 63-199649 | 8/1988 | Japan | 347/102 |
| 3-028727 | 6/1989 | Japan | 347/106 |
| 2286250 | 11/1990 | Japan | 347/101 |
| 3046589 | 7/1991 | Japan . | |
| 623977 | 2/1994 | Japan | 34/101 |
| 5318721 | 12/1998 | Japan | 347/101 |
| WO81001161 | 4/1981 | WIPO . | |
| WO81-03306 | 11/1981 | WIPO . | |

OTHER PUBLICATIONS

English Abstract of JP 3–046589.
English Abstract of JP 62–57750.

*Primary Examiner*—John Barlow
*Assistant Examiner*—Craig A. Hallacher
*Attorney, Agent, or Firm*—Fitzpatrick, Cella, Harper & Scinto

[57] ABSTRACT

An object is to provide ink jet printed products superior in the image quality such that ink jet printing onto the cloths satisfy the various conditions regarding the density, resolution, and graininess of dot. To accomplish this object, when an image is formed by a number of dots obtained by discharging the ink from a print head to attach the ink onto the cloths, the ink amount discharged from the printing head onto the cloths is controlled to produce ink jet printed products so that the average value of equivalent circle diameter for each dot after image formation may be three-fourths or less the average value of diameters of fibers constituting the cloths. Thereby, ink jet printed products excellent in image quality can be obtained with blurs reduced and high graininess of dot.

103 Claims, 25 Drawing Sheets

PRIOR TO FIXATION PROCESS

*EMBODIMENT 1*

AFTER FIXATION PROCESS

*EMBODIMENT 1*

PRIOR TO FIXATION PROCESS

PRIOR ART

PRIOR TO FIXATION PROCESS

EMBODIMENT 1

AFTER FIXATION PROCESS

EMBODIMENT 1

AFTER DEPOSITING DOT

EMBODIMENT 1

AFTER FIXATION

EMBODIMENT 1

PRIOR ART

PRIOR TO FIXATION PROCESS

EMBODIMENT 2

AFTER DEPOSITION PROCESS

EMBODIMENT 2

AFTER DEPOSITING DOT

EMBODIMENT 2

AFTER DEPOSITION

EMBODIMENT 2

APPARATUS AND METHOD FOR MANUFACTURING INK JET PRINTED PRODUCTS AND INK JET PRINTED PRODUCTS MANUFACTURED USING THE METHOD

This application is a continuation of application Ser. No. 08/093,622 filed Jul. 20, 1993, now abandoned.

BACKGROUND OF THE INVENTION

1. Field of the Invention

The present invention relates to an apparatus and method for manufacturing ink jet printed products which are printed by discharging the ink onto printing media such as the cloths made of cotton, silk and others, and printed products obtained using the method. Note that a manufacturing apparatus and method according to the present invention may be used in offices, but is preferably intended for industrial purposes.

Note that the term "print" as used in this specification means the textile printing. Also, the term "coloring matter fixing on to the printing medium" means coloring the printing medium with a coloring matter or dyestuff to the extent not causing substantially any colorless portion by washing.

2. Related Background Art

Conventionally, textile printing apparatuses typically apply the screen textile printing method of using a silk screen plate to make the printing directly onto the cloths. The screen textile printing is a method in which for an original image to be printed, a silk screen plate is first prepared for each color used in that original image, and the ink is directly transferred through silk meshes onto the cloths to effect the coloring.

However, such screen textile printing method has the problem associated therewith that a great number of processes and days are required to fabricate screen plates, and the operations such as the proportion of color inks required for the printing, and the alignment of screen plate for each color, are necessary. Moreover, the apparatus is large in size, and becomes larger in proportion to the number of used colors, requiring a larger installation space, and further the storage space for silk screen plates.

On the other hand, ink jet recording apparatuses have been practically used which have the features of a printer, a copying machine and a facsimile apparatus, or are useful as the output unit of the composite electronic equipment including a computer or a word processor, or the work station, and it has been proposed that such an ink jet recording apparatus is used for the textile printing of discharging the ink directly onto the cloths (for example, Japanese Patent Publication No. 62-57750 and Japanese Patent Publication No. 63-31594).

The ink jet recording apparatus performs recording by discharging the ink from recording means (recording head) onto the recording medium, and has the advantages of easy formation of compact recording means, image recording at high definition and at high speeds, lower running costs and less noise due to non-impact method, and easy recording of color image with multi color inks.

In particular, ink jet recording means (recording head) of discharging the ink by the use of heat energy can be easily fabricated having an arrangement of liquid channels (arrangement of discharge orifices) with high density by forming as films on the substrate electrothermal converters, electrodes, liquid channel walls and a ceiling plate through the semiconductor fabrication processes including etching, vapor deposition and sputtering, thereby allowing for further compact constitution.

Among the ink jet recording apparatuses, a serial type recording apparatus, adopting the serial scan method of scanning in a direction crosswise to the conveying direction (sub-scan direction) of recording medium, repeats a recording operation of recording an image with recording means mounted on a carriage movable in a scan direction along the recording medium, feeding a sheet (pitch conveying) by a predetermined amount in the sub-scan direction after one line of recording, and then, recording the next line of image onto the recording medium as positioned, until the entire recording for the medium is accomplished.

On the other hand, a line type recording apparatus which performs the recording only by sub-scanning in a conveying direction of recording medium repeats an operation of setting the recording medium at a predetermined recording position, performing collectively one line of recording, feeding sheet (pitch feeding) by a predetermined amount, and then, further performing collectively the next line of recording, until the entire recording for the medium is accomplished. Such ink jet recording apparatus using line type recording means with a number of discharge orifices arranged in the sheet width direction allows for high speed recording.

If such ink jet recording apparatus is used for the textile printing, the number of processes and days required for the printing on the cloths can be greatly shortened because of no need for the screen plate for use with the screen textile printing, and the apparatus can be formed in smaller size.

As a result of examinations using the above-cited ink jet recording apparatus for the textile printing to make color printing by discharging a plurality of color inks directly onto the cloths, the present inventors have found that it is requisite to prevent the spreading and blurring of dots to obtain a high quality color image. That is, when a plurality of dots are contiguous or overlap, there was a drawback that a high definition image could not be obtained due to spreading of dots. In particular, image degradation due to blurring may be conspicuous in the color mixed portions or at the connecting portions of serial scan.

SUMMARY OF THE INVENTION

An object of the present invention is to provide a textile printed product with high definition and excellent hue without blurs.

It is another object of the invention to provide a manufacturing apparatus for ink jet printed products, comprising means for performing the printing onto a printing medium using a print head having discharge ports for use with the discharge of ink, characterized in that in the printing, an ink dot formed with one time of discharging operation through said one discharge port has an area coverage ratio of less than 100% relative to the area of a corresponding print picture element before a dye contained in said ink is fixed to said printing medium.

Also, it is another object of the invention to provide a manufacturing method for ink jet printed products, including a first step of attaching the ink onto a printing medium using a print head having discharge ports for use with the discharge of ink, and a second step of fixing a dye contained in said ink onto said printing medium, characterized in that in said first step, the ink is discharged so that an ink dot formed with one time of discharging operation through said one discharge port may have an area coverage ratio of less than 100% relative to the area of a corresponding print picture element before said second step.

In this case, a plurality of print heads may be provided to perform the color mixing printing using the inks having different color tones, wherein for each of said plurality of print heads provided corresponding to said inks having different color tones, said ink dot has an area coverage ratio of less than 100% relative to the area of said print picture element.

Also, the diameter of said ink dot before said fixation should be smaller than a pitch between adjacent picture elements.

The manufacturing apparatus for ink jet printed products according to the present invention comprises a plurality of print heads to perform the color mixing printing using the inks having different color tones, characterized in that for each of said plurality of print heads provided corresponding to said inks having different color tones, said ink dot has an area coverage ratio of less than 100% relative to the area of said print picture element.

The manufacturing method for ink jet printed products according to the present invention is a method for manufacturing ink jet printed products, including attaching the ink onto a printing medium using a print head having discharge ports for use with the discharge of ink, and fixing a dye contained in said ink to said printing medium, characterized in that the ink is discharged so that the average value of equivalent circle diameters of ink dot formed with one time of discharging operation through said one discharge port may be three-fourths or less the average value of diameters of fibers constituting said printed products after said fixation.

In this case, a plurality of print heads may be provided to perform the color mixing printing using the inks having different color tones, wherein for each of said plurality of print heads provided corresponding to said inks having different color tones, the average value of equivalent circle diameters of said ink dot is three-fourths or less the average value of said fiber diameters.

In the above constitution, there is provided means for conveying said printing medium with respect to said printing means, wherein said ink dot is formed complementarily by first and second print heads spaced apart in said conveying direction, and the drying may be made on the conveying passage between said first and second print heads.

Also, the print head may have thermal energy converters for generating the heat energy causing film boiling in the ink, as the energy for use with the discharge of inks.

Further, said print medium may be washed after said fixation, and/or a pretreatment agent may be applied to said print medium prior to printing by said printing means. Also, fixing means for fixing a dye contained in said ink to said printing medium may be further provided.

In addition, said printing medium may be cloths made of cotton, silk and others, onto which the textile printing is performed.

Further in addition, ink jet printed products of the invention can be manufactured by any of the above-described methods.

Also, ink jet printed products of the invention are characterized in that a mono-color isolated dot composed of the dye fixed on the cloths has an area coverage ratio from 70% to 100% inclusive relative to the area of a corresponding print picture element, and the area of said ink dot is 900% or less the area of said picture element. Note that the area of ink dot is preferably 400% or less the area of picture element, and more preferably 300% or less. The dots satisfying the area coverage ratio as above noted can reproduce a clear fine line without fading colors due to the dots falling within the range, thereby attaining a desired thickness.

Also, ink jet printed products of the invention are characterized in that the average value of equivalent circle diameters of mono-color isolated ink dot composed of the dye fixed onto the cloths is three-fourths or less the average value of diameters of fibers constituting said printed products.

Further, the present invention seeks to obtain articles by processing such printed products. Such articles can be obtained by cutting said ink jet printed products in desired size, and subjecting cut pieces thereof to a process for providing final articles, the process for providing final articles including stitching. And the articles may be, for example, clothes.

According to the present invention, when an image is formed by a number of dots obtained by discharging the inks from print heads, and attaching the inks onto the printing medium such as the cloths, the amount of ink discharged from the print heads onto the printing medium is appropriately set so that the area coverage ratio of a single dot before the fixation is less than 100%, and the average value of equivalent circle diameters of each dot after the fixation is three-fourths or less the average value of diameters of fibers constituting said cloths, whereby ink jet printed products having high image quality can be obtained with less blurs at the boundaries of overlapping fibers, and the high graininess of dot.

DETAILED DESCRIPTION OF THE PREFERRED EMBODIMENTS

The preferred embodiments of the present invention will be described below with reference to the drawings.

First, the present inventors have attained the following aspects as a result of careful research.

Figure 1A:
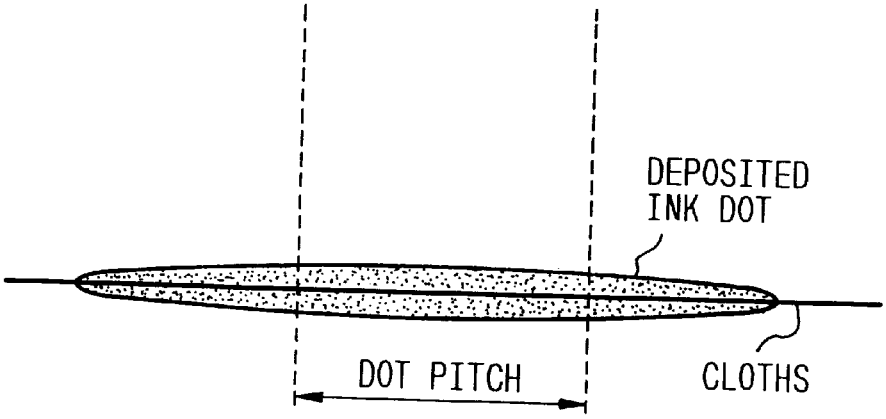
FIGS. 1A and 1B are typical views showing the state of an ink droplet attached onto the cloths of a conventional manufacturing method for ink jet printed products.
Figure 1B:
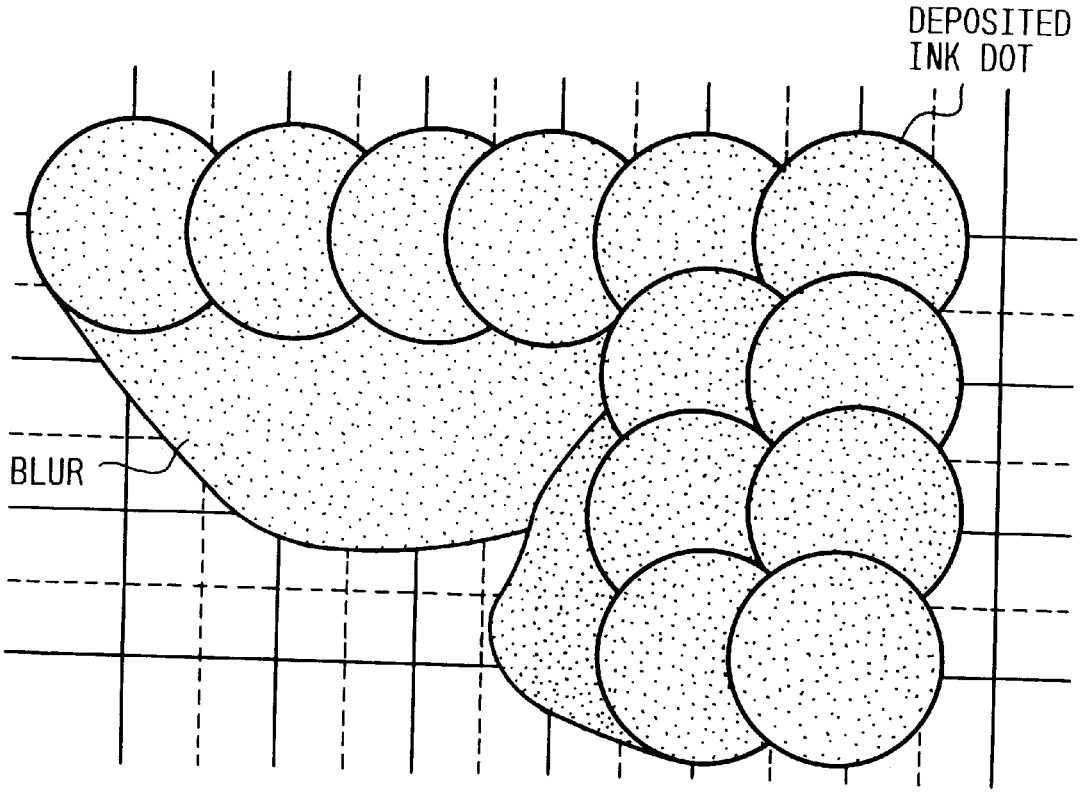

The states of ink droplets attached onto the printing medium by a conventional printing method before the fixation process including steaming, is typically shown in FIGS. 1A and 1B. In particular, the lattice line indicated by the solid line in FIG. 1B is a reference line passing through the center of ink droplet, each lattice point being an ink impinging point. An ink droplet attached onto the printing medium forms an ink dot, and when adjacent or overlapping dots occur, such ink dots may partly collapse, resulting in ink blurs. FIG. 1B illustrating the state of ink droplets is essentially a model view, wherein it is of course difficult to practically confirm overlapping portions or boundaries of ink dots with blurs. FIG. 1A is a cross-sectional view showing the relation between an ink dot attached onto the cloths and a dot pitch.

Herein, the present inventors have found, in achieving the present invention, that if the impinging point of ink droplet is supposed, and the region surrounded by a square placed around the impinging center with the distance between adjacent impinging centers (recording pitch a) as the length of one side, i.e., each region surrounded by the lattice line, as indicated by the broken line, is defined as a picture element, any blurs as shown in FIG. 1 will not occur by controlling the area coverage ratio of the area of an ink dot formed by one time of discharging operation through one discharge port (hereinafter referred to as a single dot or mono-color isolated dot) to the area of a picture element.

Figure 2:
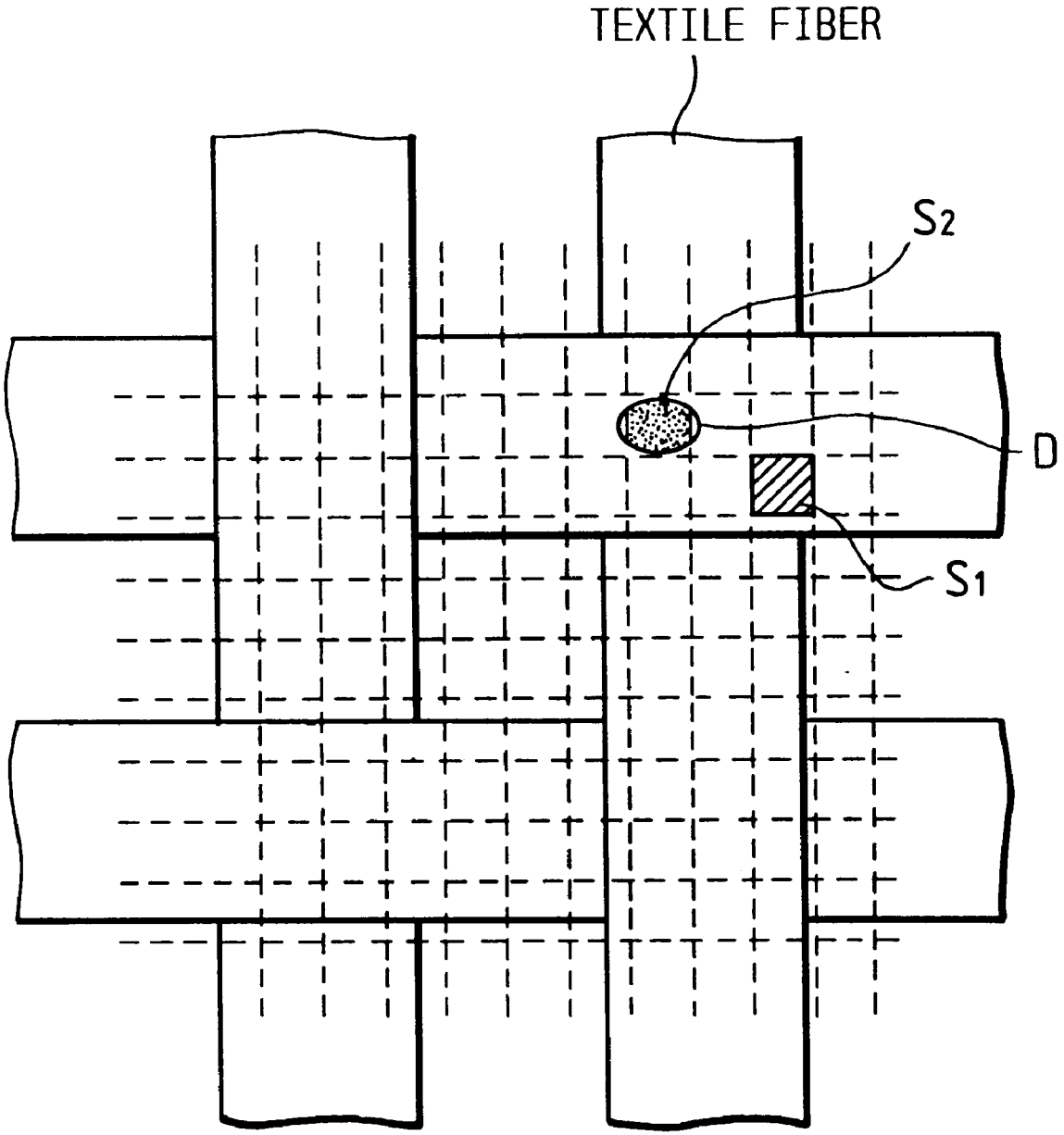
FIG. 2 is an explanation view for explaining the definition of the area coverage ratio of a single dot according to an ink jet manufacturing method of the invention.

Herein, the area coverage ratio of single dot is defined as the value represented by $S_2/S_1$, where $S_1$ is an area of one picture element surrounded by the broken line projected on to the textile fiber T woven into the cloth (an area indicated by the oblique lines in the figure) and $S_2$ is an area contained within the region of one picture element of a dot D formed by one time of ink discharging operation through one discharge port of the print head (an area indicated by hatching in the figure), as shown in FIG. 2.

That is, the area coverage ratio of single dot is a value having the upper limit of 100% in percentage, and is different from the ratio of single dot area to one picture element area (dot area ratio).

Figure 3:
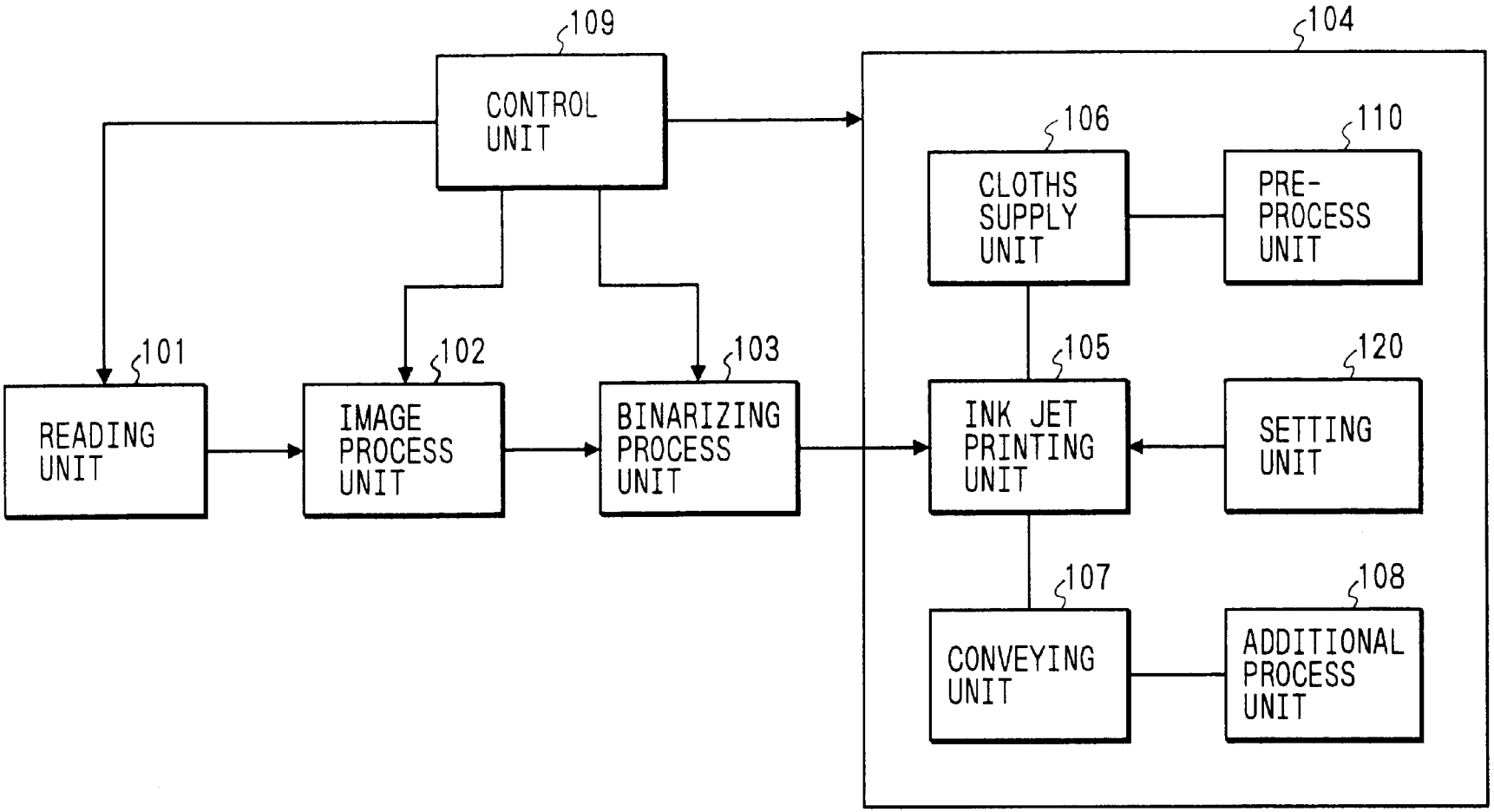
FIG. 3 is a block diagram showing a configurational example of an ink jet printed product manufacturing system to which the present invention is applied.

FIG. 3 is a typical block diagram showing the configuration of a printing system according to one embodiment of the present invention.

This print system is constituted of a reading unit 101 for reading an original image created by a designer, an image process unit 102 for processing original image data read, a binarizing process unit 103 for binarizing image data processed by the image process unit 102, and an image printing unit 104 for performing the printing onto the cloths as the printing medium on the basis of image data binarized.

The image reading unit 101 reads an original image with a CCD image sensor for the output of an electrical signal to the image process unit 102. The image process unit 102 creates print data for driving an ink jet printing unit 105 which discharges four color inks of magenta (M), cyan (C), yellow (Y) and black (Bk) as will be described later from input original data. Creating recording data involves image processing for reproducing original image with ink dots, coloration for determining color tones, alteration of layout, and selection of the design size such as enlargement or reduction.

The image printing unit 104 is constituted of the ink jet printing unit 105 for discharging the ink based on recording data, a pre-process unit 110 for performing an appropriate pre-processing (hereinafter described) on the cloths for the printing, a cloths supply unit 106 for supplying the cloths as pre-processed to the ink jet printing unit 105, a conveying unit 107 for precisely conveying the cloths provided opposed to the ink jet printing unit 105, and an additional process unit 108 for additionally processing, such as fixation, washing and drying, and accommodating the cloths as recorded. Note that 120 is a setting unit for variably setting the ink discharge amount in accordance with the printing conditions such as the picture element density and the kind of printing medium, this unit being provided as required.

(Apparatus Example 1)

Figure 4:
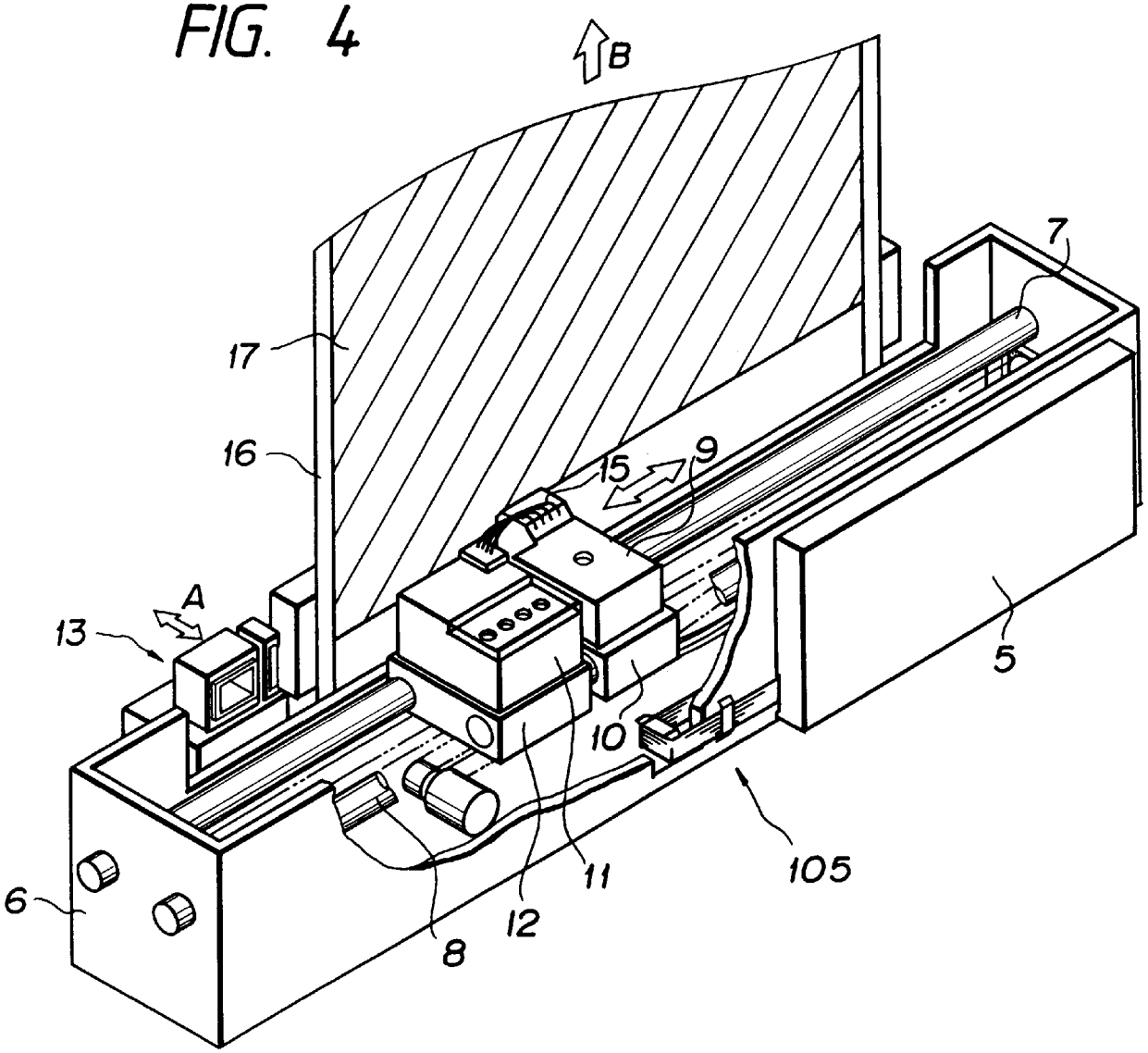
FIG. 4 is a perspective view showing an example of the configuration of an ink jet printing unit in FIG. 3.

FIG. 4 is a perspective view showing an example of ink jet printing unit 105 apparatus for use with the present invention.

The ink jet printing unit 105 is largely constituted of a frame 6, two guide rails 7, 8, an ink jet head 9 and a carriage 10 for the movement thereof, an ink supply device 11 and a carriage 12 for the movement thereof, a head recovery device 13, and an electrical system 5. The ink jet head 9 (hereinafter simply referred to as a head) comprises a plurality of columns of discharge ports, and converters for converting an electric signal into energy for use in discharging the ink, and is further provided with a mechanism for selectively discharging the ink through the columns of discharge ports in accordance with an image signal sent from the binarizing process unit 103.

The head may be a print head which discharges the ink by the use of heat energy, which is preferably a head comprising heat energy converters for generating the heat energy for the supply to the ink, thereby causing state changes in the ink due to heat energy applied by the heat energy converters to discharge the ink through discharge ports based on the state changes.

The ink supply device 11 serves to store the ink, and supply a necessary amount of ink to the head, and comprises an ink tank and an ink pump (both not shown) or others. This device 11 and the head 9 are connected via ink supply tubes 15, whereby the head is automatically supplied with the ink, owing to its capillary action, by the amount corresponding to that as discharged. In the head recovery operation as will be later described, the ink is compulsorily supplied to the head 9 by using the ink pump.

The head 9 and the ink supply device 11 are mounted on the head carriage 10 and the ink carriage 12, respectively, for the reciprocal movement along the guide rails 7, 8 by a driving device, not shown.

The head recovery device 13 is provided at a home position (waiting position) of the head and opposed to the head 9 to maintain the ink discharge from the head 9 stable, and is movable forward and backward in the directions of the arrow A to perform the following specific operations.

First, when not operated, the head recovery device makes a capping for the head 9 at the home position (capping operation) to prevent the evaporation of ink from the nozzles of the head 9. Further, it serves to perform the operation of compulsorily discharging the ink through the nozzles by pressurizing the ink flow channels within the head 9 using an ink pump (pressure recovery operation) to remove bubbles or dirts out of the nozzles, before the start of image recording, or to withdraw the ink discharged with the operation of compulsorily sucking and discharging the ink through the nozzles (suction recovery operation).

An electrical system 5 comprises a power supply unit and a control unit for performing the sequence control of the whole ink jet recording unit. The cloths are conveyed a predetermined distance in a sub-scan direction (or a direction of the arrow B) by a conveying device, not shown, every time the head 9 has recorded a predetermined length by moving in a main scan direction along the carriage 7, to achieve the formation of image. In the figure, an oblique line portion 17 indicates the recorded portion.

It should be noted that the recording head 9 may be an ink jet recording head for the monochrome recording, a plurality of recording heads for the color recording having different color inks, or a plurality of recording heads for the gradation recording with the same color at different densities.

Also, it should be noted that this apparatus is applicable to the cartridge type in which recording head and ink tank are integrated, as well as the other type in which recording head and ink tank are separately provided and connected via an ink supply tube, wherein the constitution of recording means and the ink tank is not concerned.

(Apparatus Example 2)

Figure 5:
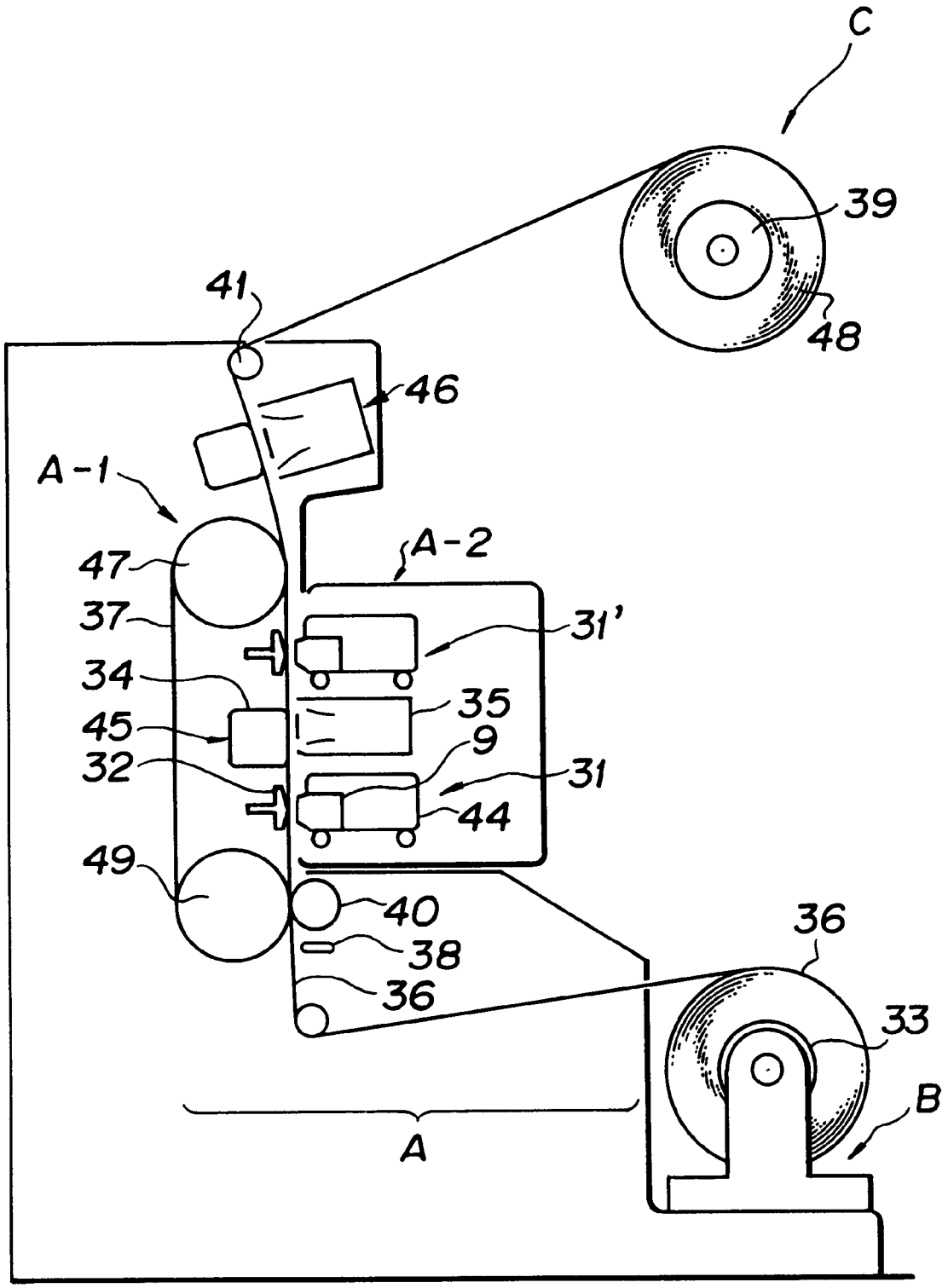
FIG. 5 is a schematic side view showing another configurational example of the image printing unit in FIG. 3.
Figure 6:
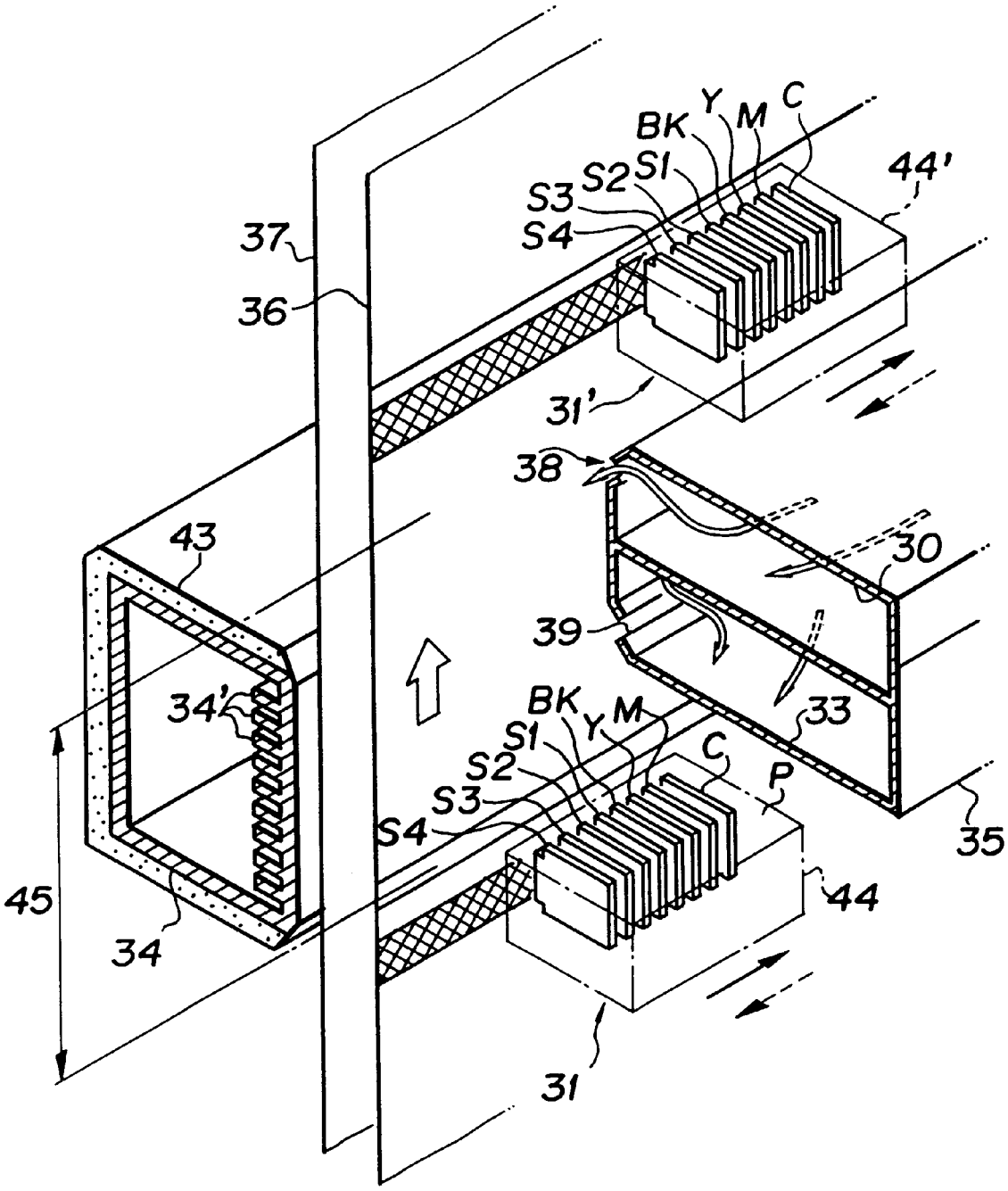
FIG. 6 is a perspective view showing the configuration of an ink jet printing unit in FIG. 5.

FIG. 5 is a typical view showing diagrammatically a second example of a printing unit to which the method of the present invention is preferably applicable. The printing unit is largely comprised of a cloth supply unit B for delivering printing medium such as a cloth pretreated for the textile printing and wound around a roller 33, a main unit for performing the printing by using an ink jet head while precisely feeding the cloths delivered, and a winding unit C having a roller 39 for winding the printed cloths after drying. And the main unit A further comprises a precision cloth feeding unit A-1 including a platen and a print unit A-2. FIG. 6 is a perspective view showing in detail the constitution of the print unit A-2.

The operation of this apparatus will be now described using an instance of performing the textile printing onto the cloths pretreated as the printing medium.

The pretreated roll-like cloths 36 are delivered toward the cloth supply unit to the main unit A. In the main unit, a thin endless metallic belt 37 which is precisely driven stepwise is looped around a drive roller 47 and an idler roller 49. The drive roller 47 is directly driven stepwise by a stepping motor (not shown) of high resolution to feed the belt 37 stepwise by the amount of steps. The delivered cloths 36 are firmly pressed onto the surface of the belt 37 backed up with the idler roller 49 by a presser roller 40.

The cloths 36 fed stepwise by the belt are positioned at a predetermined position in a first print unit 31 under a platen 32 on the back side of the belt, and printed by the ink jet head 9 on the front side thereof. Every time one line of print is terminated, the cloths are fed by a predetermined step, and then dried through the heating by a heating plate 34 disposed on the back side of the belt, in addition to the hot air from the surface supplied/exhausted by a hot air duct 35. Subsequently, in a second print unit 31', overlap printing is performed in the same way as in the first print unit. Note that the hot air duct 35 may not be necessarily provided, but when this is omitted, air drying (natural drying) is made in the portion from the first printing unit 31 to the second printing unit 31'.

The printed cloths are separated from the surface of the belt 37, dried again by a post drying unit 46 similar to the heating plate and the hot air duct as previously described, guided by a guide roll 41, and wound around a winding roll 48. And the wound cloths are removed from the main device, and subjected to additional processing such as coloring (fixation), washing, and drying to be performed in batch processing to provide the final products.

The details of the print unit A-2 will be described below with reference to FIG. 6. Herein, the preferred embodiment is such that the first print unit head prints information with the dots culled out in a staggered manner, for example, by discharging the ink, drying process is passed through, and the second print unit head prints complementary information culled out by the first print unit by discharging the ink. In this way, the process of air drying or compulsory drying between each printing makes it possible to further reduce the occurrence of blurs of dots as printed when the same quantity of ink is used.

In FIG. 6, the cloth 36 as the of printing medium is supported by the belt 37 and fed stepwise in an upper direction as shown. In the first print unit 31 provided downward in the figure, there is provided a first carriage 44 having thereon the ink jet heads of specific colors S1 to S4, as well as Y, M, C and Bk. The ink jet head (print head) in this embodiment has elements for generating the heat energy causing film boiling in the ink as the energy used to discharge the ink, and has 128 or 256 discharge ports arranged with a density of 400 dpi (dots/inch).

Downstream of the first print unit is provided a drying unit 45 comprised of a heating plate 34 for heating from the back side of the belt, and a hot air duct 35 for drying from the front side. The drying process with this drying unit 45 is mainly intended to evaporate the ink solvent attached onto the printing medium, and is different from the diffusion or fixation process as will be later described. The heat transfer surface of the heating plate 34 is pressed against the endless belt 37 tightly tensioned to strongly heat the conveying belt 37 from the back side thereof with the vapor of high temperature and high pressure passing through a hollow inside. On the inner face of the heating plate, fins 34' for the collection of heat are provided to concentrate the heat on the back side of the belt efficiently. The plane of the heating plate out of contact with the belt is covered with a heat insulating material 43 to prevent the heat loss due to heat radiation.

On the front side, the drying effect is further enhanced by blowing thereto dry hot air from a supply duct 30 disposed downstream to apply the air of lower humidity to the drying cloths. And the air containing sufficient moisture and flowing in the opposite direction to a conveying direction of the cloths is sucked in a much greater amount than a blowing amount by a suction duct 33 disposed upstream, so that evaporated water contents are prevented from wetting and bedewing surrounding mechanical components. A supply source of hot air is provided on the rear side of FIG. 6, and the suction is performed from the fore side, so that the pressure difference between a blow-off opening 38 and a suction opening 39 placed opposed to the cloths is rendered even over the entire area in a longitudinal direction. Air blowing/suction unit is offset downstream relative to a center of the heating plate provided on the back side, so that the air may be blown to sufficiently heated portion. Thereby, it is possible to strongly dry a quantity of water contents in the ink including a reducer discharged by the first print unit 31 and received into the cloths.

On the downstream (upper) side thereof, there is provided a second print unit 31' which is comprised of a second carriage 44' of the same constitution as the first carriage.

A preferable example of the manufacturing method for ink jet printed products will be presented below.

Figure 7:
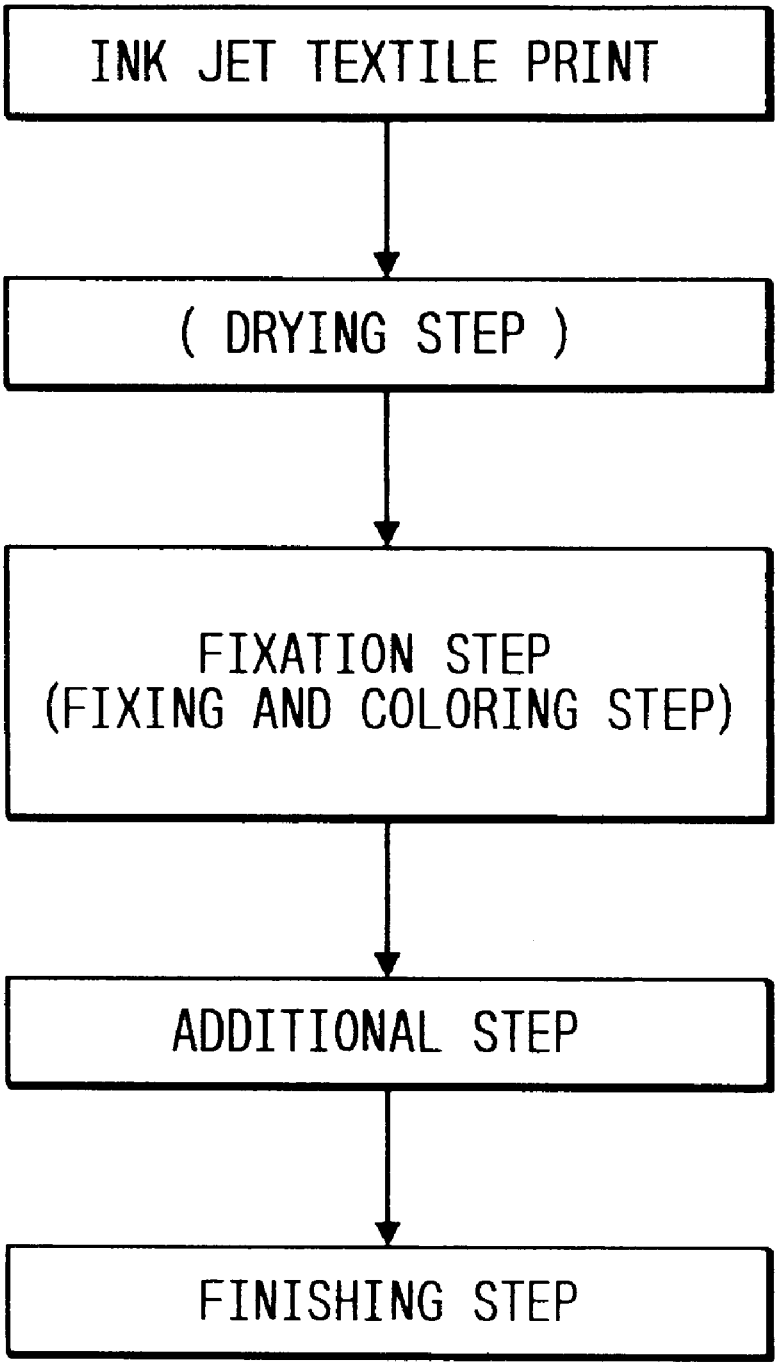
FIG. 7 is a process diagram for explaining one embodiment of the manufacturing method for ink jet printed products according to the invention.

FIG. 7 is a block diagram for explaining this method, including the steps of ink jet textile printing, and drying (including air drying), as shown in the figure. And subsequently, a step of diffusing and fixing therein coloring matter such as a dye in the ink deposited on the fibers of the cloths, using means for fixing such coloring matter contained in the ink. This step can allow sufficient coloring and fastness to be given due to fixation of dye.

The diffusion and fixation step (including a dye diffusion step and a fixing and coloring step) may be any of the conventional well-known methods, including a steaming method (e.g., treated at 100° C. under water vapor atmosphere for ten minutes). In this case, before the textile printing, the cloths may be subjected to alkaline pretreatment. Also, the fixation step may or may not involve a reaction step such as ionic bonding depending on the dye. The latter example may include impregnating the fiber not to cause physical desorption. Also, the ink may be any of the appropriate inks containing a desired coloring matter, which may be not only a dye but also a pigment.

Thereafter, in the additional step, unreacted dye and substances used in the pretreatment are removed. Finally, the finishing step such as defect correction and ironing is passed through to complete the printing.

The printing medium may be the cloths, a wall cloth, an embroidery thread and a wall paper.

Note that the cloths may include all woven or nonwoven fabrics and other cloths, irrespective of materials and how to weave and knit.

In particular, the cloths for ink jet textile printing are required to have the properties of:

(1) being colored with the ink at sufficient densities
(2) having high dyeing rate of ink
(3) rapidly drying the ink on the cloths
(4) causing less irregular blurs of ink on the cloths
(5) having excellent conveyance capability within the apparatus To meet these requirements, the cloths may be pre-treated as necessary by using means for adding a treatment agent in this invention. For example, in Japanese Laid-Open Patent Application No. 62-53492, several kinds of cloths having the ink receiving layer have been disclosed, and in Japanese Patent Publication No. 3-46589, the cloths containing a reduction inhibitor or alkaline substances have been proposed. The examples of such pre-treatment may include treating the cloths to contain a substance selected from alkaline substance, water soluble polymer, synthetic polymer, water soluble metallic salt, urea, and thiourea.

Examples of alkaline substance include alkaline metal hydroxide such as sodium hydroxide and potassium hydroxide, amines such as mono-, di-, or tri-ethanolamine, and carbonic acid or alkaline metal bicarbonate such as sodium carbonate, potassium carbonate and sodium bicarbonate. Further, they include organic acid metallic salt such as calcium acetate and barium acetate, ammonia and ammonium compounds. Also, sodium trichtoracetate which becomes alkaline substance under dry heating may be used. Particularly preferable alkaline substance may be sodium carbonate and sodium bicarbonate for use in coloring of reactive dye.

Examples of water soluble polymer include starch substances such as corn and wheat flour, cellulose substances such as carboxymethyl cellulose, methyl cellulose and hydroxyethyl cellulose, polysaccharides such as sodium alginate, gum arabic, locust bean gum, tragacanth gum, guar gum, and tamarind seeds, protein substances such as gelatine and casein, and natural water soluble substances such as tannin and lignin.

Also, example of synthetic polymer include polyvinyl alcohol compounds, polyethylene oxide compounds, acrylic acid type water soluble polymer, and maleic anhydride type water soluble polymer. Among them, polysaccharide polymer and cellulose polymer are preferable.

Examples of water soluble metallic salt include compounds having a pH of 4 to 10 and making typical ionic crystals such as halides of alkaline metal and alkaline earth metal. Typical examples of such compound include alkaline metals such as NaCl, $Na_2SO_4$, KCl and $CH_3COONa$, and alkaline earth metals such as $CaCl_2$ and $MgCl_2$. Among them, salts of Na, K and Ca are preferable.

The method of pre-treating the cloths to contain any of the above-cited substances is not specifically limited, but may be normally any one of dipping, pad, coating, and spray methods.

Further, since the textile printing ink applied to the cloths for ink jet textile printing may only adhere to the surface of the cloths in the jetted state thereto, the fixation process of fixing a coloring matter in the ink such as a dye onto the fibers is subsequently preferably performed as previously described. Such fixation process may be any one of conventionally well-known methods, including, for example, a steaming method, an HT steaming method, or a thermofix method, and if not using the cloths pretreated with alkali, an alkali pad steam method, an alkali blotch steam method, an alkali shock method, and an alkali cold fix method.

Further, the removal of unreacted dye and substances used in pretreatment can be made by washing the printing medium in the water or hot water having neutral detergent dissolved therein, using means for washing the printing medium, by any of conventionally well-known methods after the fixing process. Note that it is preferable to use any one of conventional well-known fixation processes (for the fixation of falling dye) jointly with the washing.

It should be noted that the printed products subjected to the additional process as above described are then cut away in desired size, cut pieces are subjected to the process for providing the final articles such as stitching, bonding, and welding, to provide the clothes such as a one-piece dress, a dress, a necktie or a swimming suit, a bedclothes cover, a sofa cover, a handkerchief, and a curtain. A number of methods for processing the cloths by stitching or otherwise to provide the clothes or other daily needs have been described in well-known books, for example, monthly "Souen", published by Bunka Shuppan.

In the present invention, the area coverage ratio of ink dot (single dot) before the fixation process of coloring matter contained in the ink onto the printing medium is made less than 100% relative to a picture element, less than 95%, less than 90%, or less than 80%, so that a clearer image can be obtained. Also, the area coverage ratio is preferably 15% or greater. With 15% of greater, sufficient density can be exhibited in the reactive fixation process of the dye.

In order to set up the dot area or the area coverage ratio, it is necessary to appropriately set the pulse waveform of a driving electrical signal for the application to heat energy converters of the print head, i.e., set the voltage value and/or the pulse width of a pulse signal to an appropriate value. Or it is also possible to provide means for appropriately converting the image signal for the supply to the image printing unit 104 as shown in FIG. 3, or means for converting binarized signal received in the ink jet printing unit 105. Instead of converting the electrical signal, as above, it is alternatively conceived to appropriately determine the mechanical constitution of print head itself, e.g., the discharge port diameter, or to employ heat energy converters by appropriately determining the heat generation. Further, the ink discharge amount is greatly dominated by the ink viscosity, and due to the ink viscosity having a property of temperature dependency, the appropriate temperature control for the print head or the ink can be made.

In addition, the setting of discharge amount may be fixed to provide a preferred area coverage ratio, if the printing conditions such as the picture element density or the printing medium used are not changed, but it may be varied to cope with the situations where the printing conditions are changed. In this case, a setting unit 120 may be arranged in the ink jet printing unit 105, as shown in FIG. 3, to variably set the pulse waveform of electrical signal, convert and set binarized signal or set the temperature. Such setting unit 120 can further include print condition input means such as means for accepting an instruction input for the print condition by the operator, means for accepting an instruction input from the control unit 109, or means for discriminating the type of printing medium. Or such setting means or print condition input means may be provided on the side of supplying image data to an image printing unit 104 (e.g., a control unit 109).

Note that the area can be measured and evaluated by the observation using a microscope.

The present invention will be further described in connection with specific examples.

(Example 1)

Where an ink jet printing unit as shown in FIG. 4 is used, and a print head having heat energy converters for generating the heat energy given to the ink, and 256 nozzles at 400 dpi, with the nozzle diameter of 22×33 $\mu$m for the nozzle of rectangular shape, is mounted, the ink is discharged onto the cloths at an average discharge amount of 45 pl/nozzle for the printing. Herein, the cloth used is cotton (lawn) formed as the plain fabrics of textile fiber having an average diameter of 200 $\mu$m.

The inks used were of four colors as shown in the following, whereby the full color printing was made. Each composition is listed below.

| Ink composition: | | Parts by weight |
|---|---|---|
| (1) | Reactive dye C.I. Reactive Blue | 10 |
| | Thiodiglycol | 15 |
| | Diethylene glycol | 15 |
| | Water | 60 |
| (2) | Reactive dye C.I. Reactive Red | 10 |
| | Thiodiglycol | 15 |
| | Diethylene glycol | 15 |
| | Water | 60 |
| (3) | Reactive dye C.I. Reactive Yellow | 10 |
| | Thiodiglycol | 15 |
| | Diethylene glycol | 15 |
| | Water | 60 |
| (4) | Reactive dye C.I. Reactive Black | 15 |
| | Thiodiglycol | 15 |
| | Diethylene glycol | 15 |
| | Water | 55 |

Figure 8A:
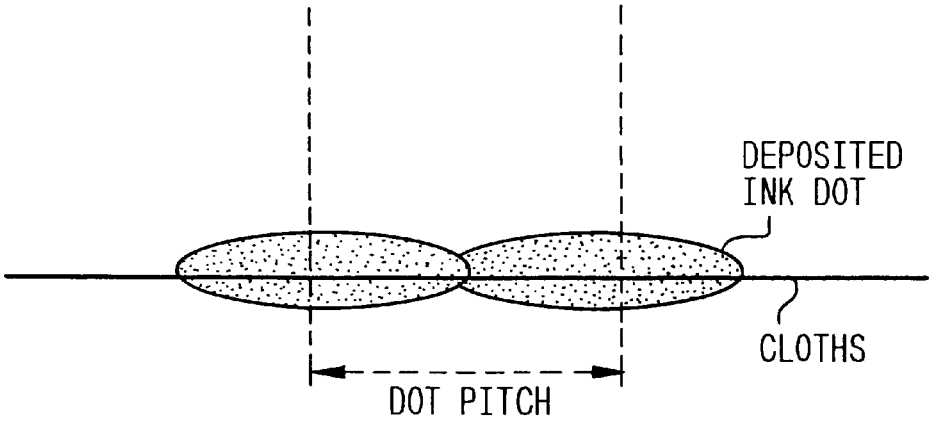
FIGS. 8A and 8B are typical views showing the states of ink droplets on the cloths before the fixation process in an example 1.
Figure 8B:
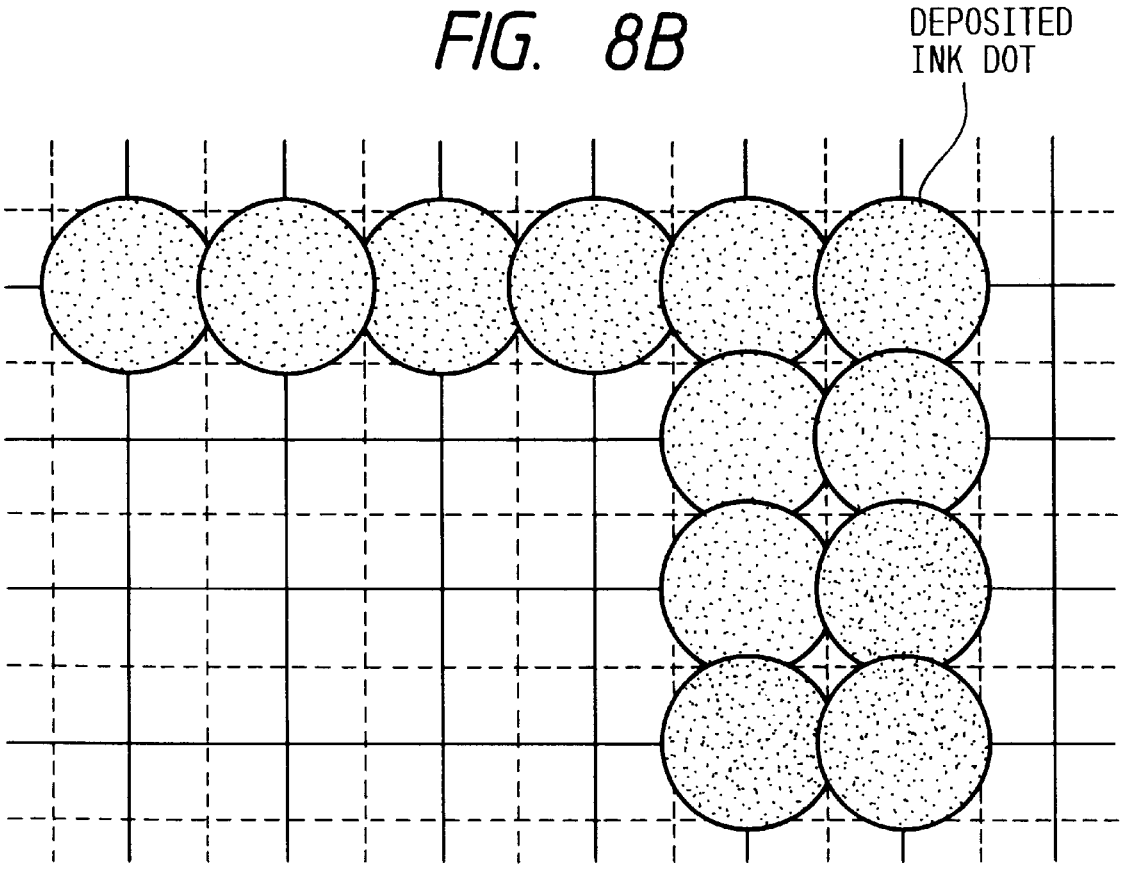
Figure 9A:
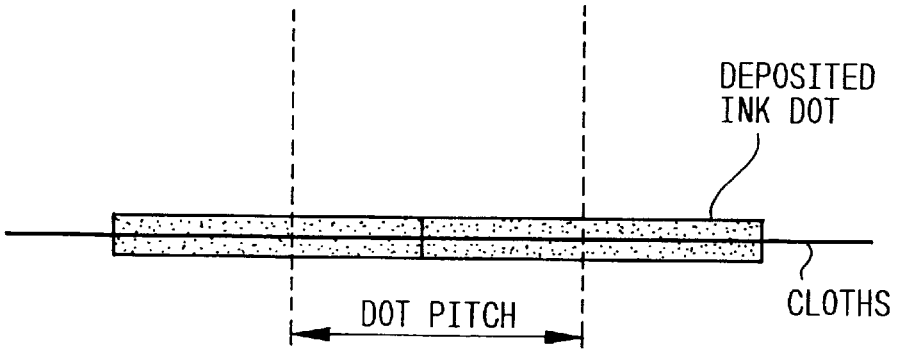
FIGS. 9A and 9B are typical views showing the states of ink droplets on the cloths after the fixation process in the example 1.
Figure 9B:
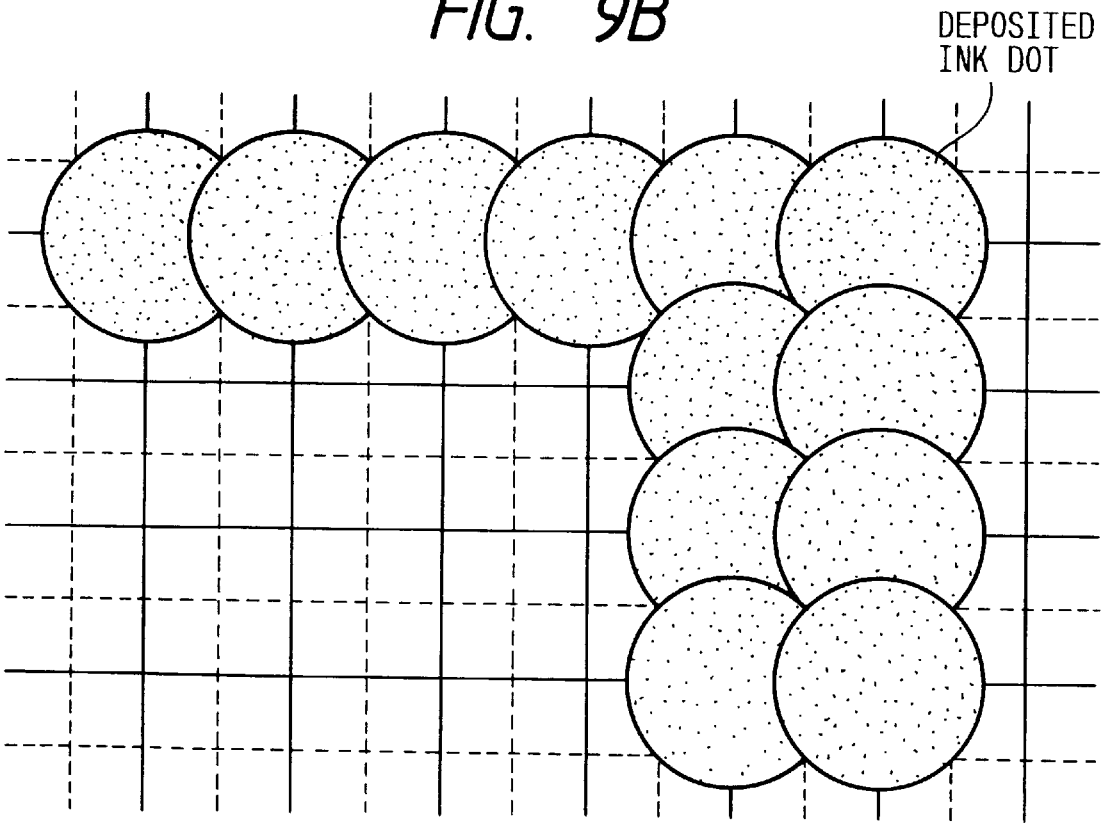

If a dot image is formed on the cloths under the conditions of this embodiment, using these inks, it is expected that the printed state as shown in FIGS. 8A and 8B is obtained having less blurs as compared with the printed state in the conventional example as typically shown in FIGS. 1A and 1B. Also, it is expected that even after the fixation process such as the steaming, excellent printed products with no blurs can be obtained as typically shown in FIGS. 9A and 9B.

Figure 10:
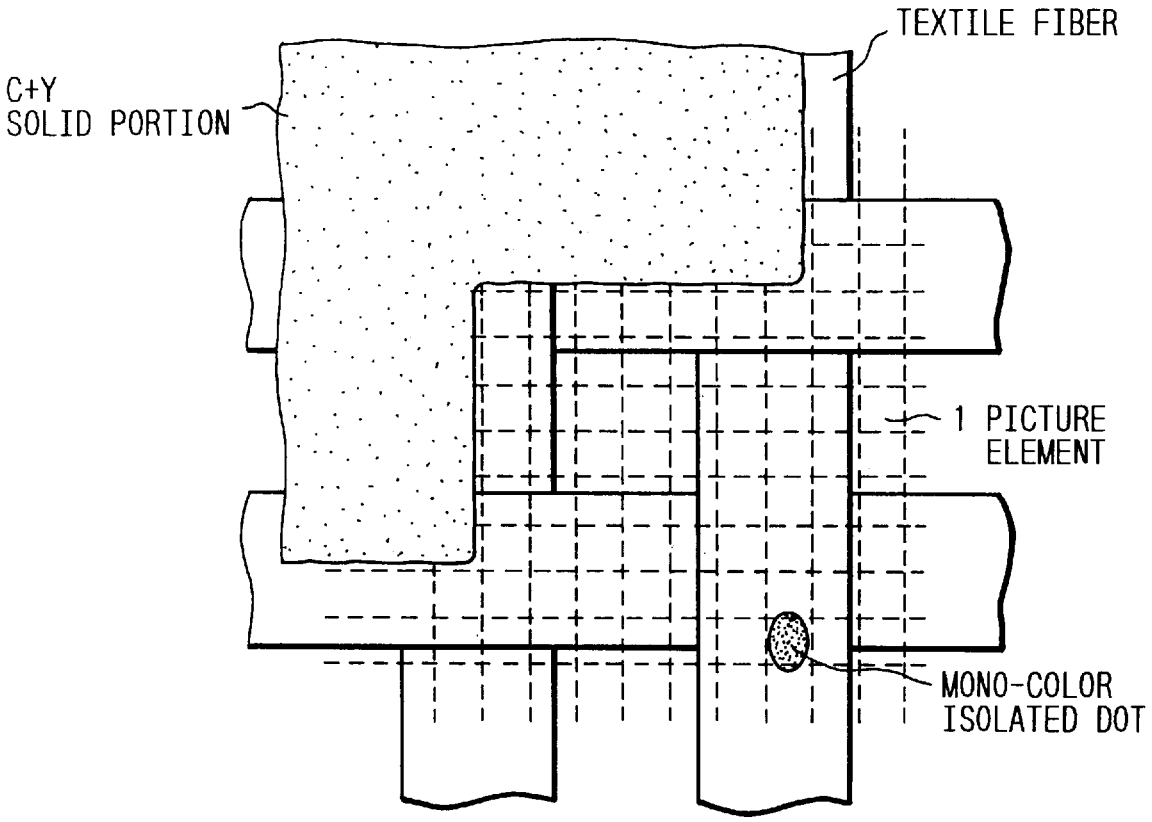
FIG. 10 is a view showing the state of an image formed on the cloths under the conditions of example 1 before the fixation.

Thus, using a (1) cyan (C) ink and (3) yellow (Y) ink, an image composed of the fine line portion with overlap prints of both and the isolated dot portion of C ink single color was formed on the cloths, and was then subjected to air drying, so that an excellent printed result without blurs was obtained as shown in FIG. 10.

Then, it could be confirmed by an image analysis system that the average value of area coverage ratios of ink single dot to picture element area for twenty samples was 90%.

Note that the area coverage ratio of single dot was obtained using the image analysis system as shown below.

Input system: Optical microscope (×100) and CCD camera (made by Victor Company of Japan; KY-F30)

Image processing system: Personal computer for control (made by NEC; PC-9800RL)

Image processing unit (made by PIAS; LA-555, 512×512 pixels)

Display system: TV monitor (made by Victor Company of Japan; V-1000)

Figure 11:
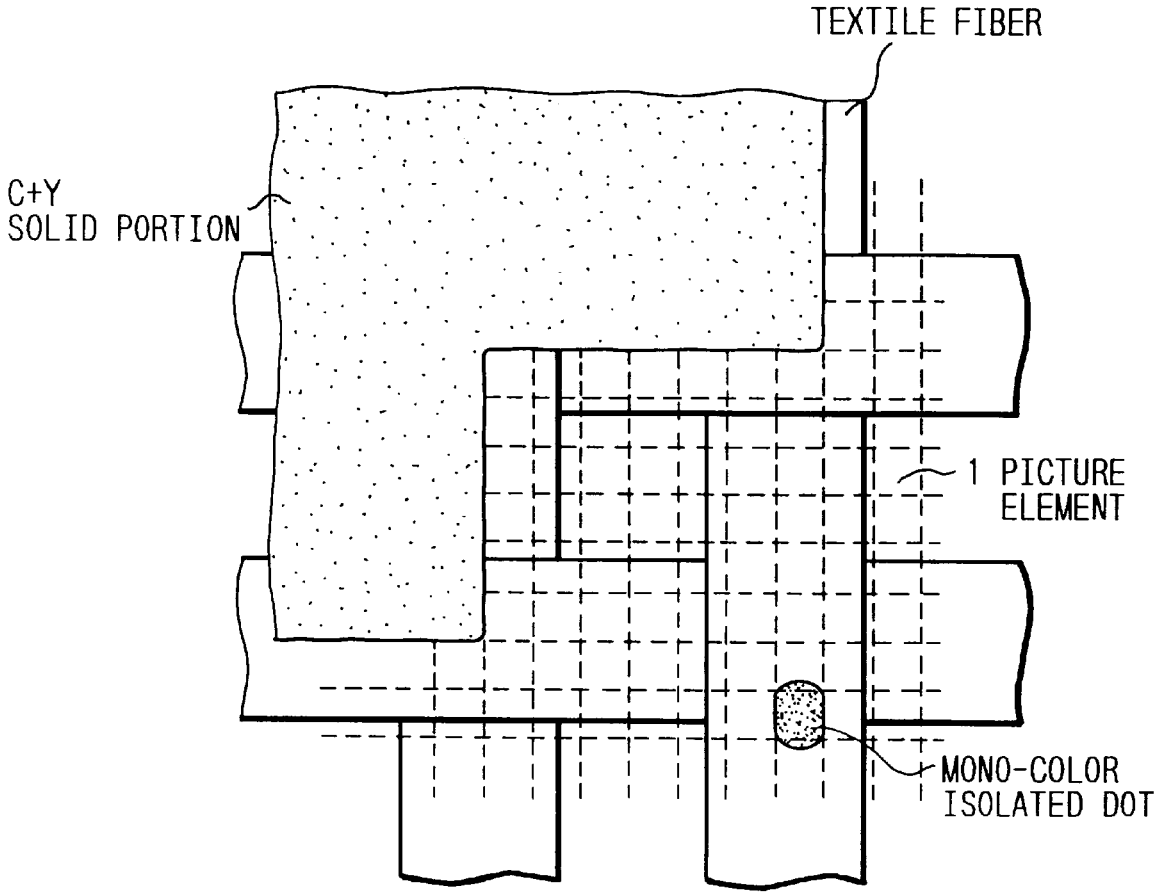
FIG. 11 is a view showing the state of the image formed on the cloths under the conditions of example 1 after the fixation.

Using the above system, a single dot image was first stored in the image processing unit, a binarized dot shape was extracted, the region of one print picture element was appropriately projected thereonto, the number of pixels read by CCD was counted for dot elements contained in the region, the total sum of areas of read pixels by the number of read pixels (corresponding to $S_2$ in FIG. 2) was obtained, so that the actual area coverage ratio was calculated by dividing the area of one print picture element ($S_1$) by the value $S_2$. The image of FIG. 10 was subjected to well-known steaming process, diffusing, fixing and coloring the dye on the cloths, so that an excellent image having sufficient densities without blurs in the color mixed portion was obtained. The observation of the solid portion revealed that the area coverage ratio of single dot was 100%, there was no gap between adjacent dots, and the substantial entire region was colored by a coloring dye, as shown in FIG. 11.

Figure 12:
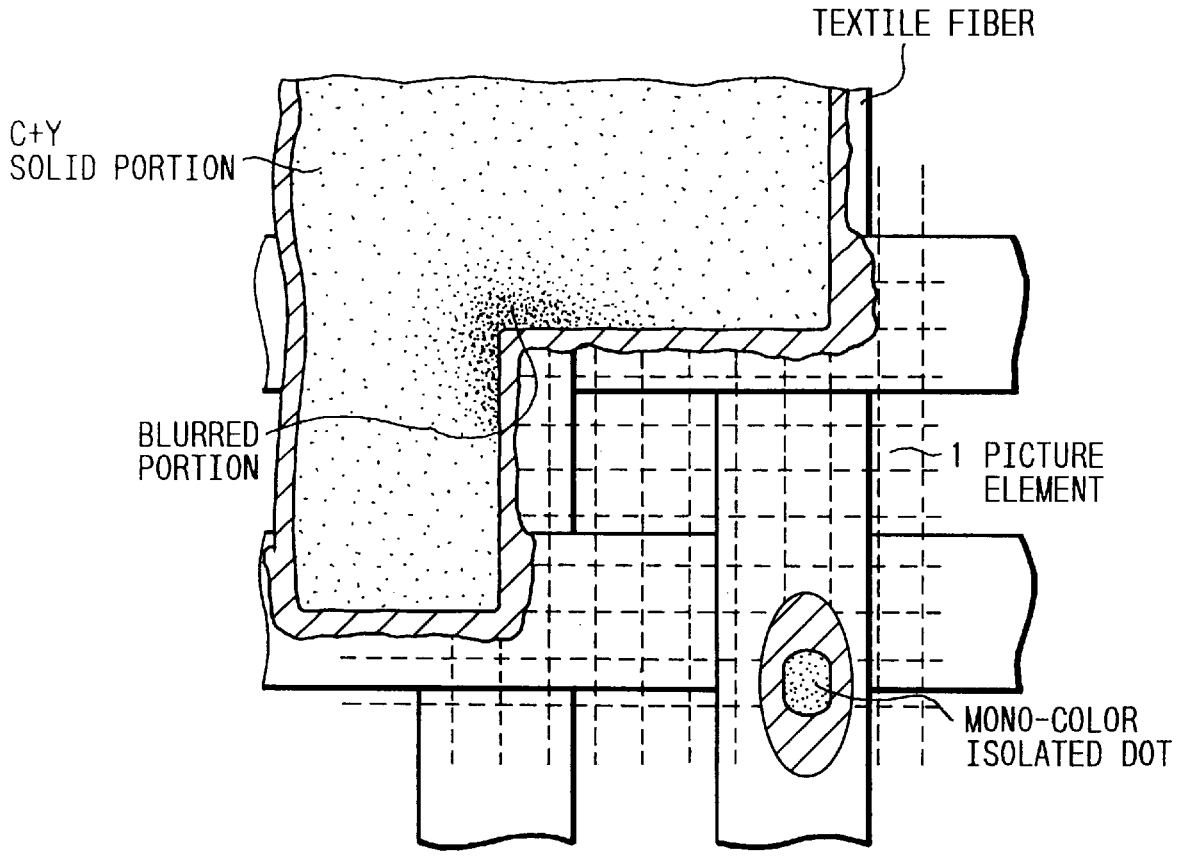
FIG. 12 is a view showing the state of an image formed on the cloths, as shown in FIG. 10, with the area coverage ratio of 100%, before and after the fixation.

On the contrary, with the area coverage ratio of single dot before the fixation process being 100%, if like image as above was formed, it could be confirmed that blurs arose as indicated by the painted portion in the fine line portion formed by color mixing, as in FIG. 12, and after the fixation process, the dye further spread over the hatched portion, resulting in the print quality being remarkably degraded.

Figure 13:
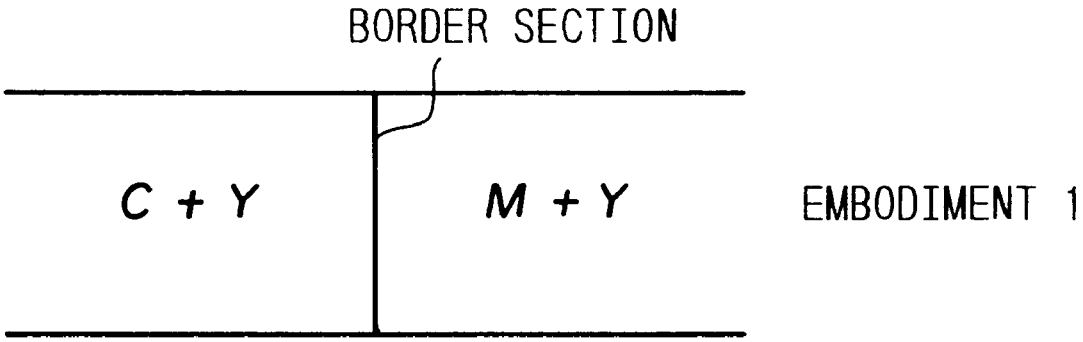
FIG. 13 is a view showing the state where solid images having different colors are formed adjacent each other on the cloths under the conditions of example 1.
Figure 14:
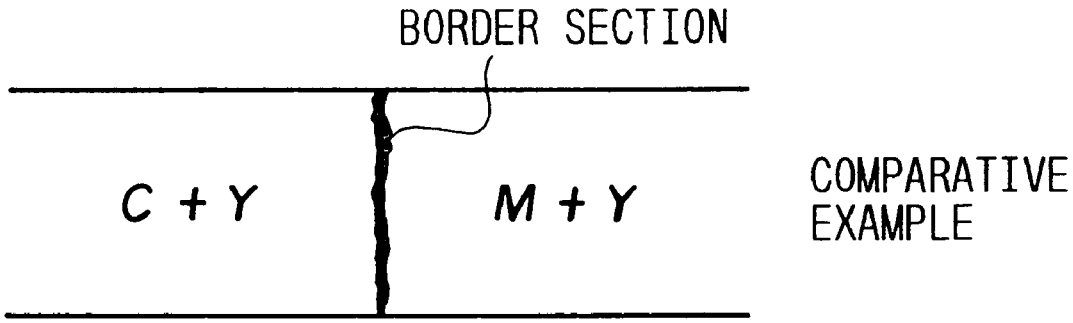
FIG. 14 is a view showing the state where similar solid images as shown in FIG. 13 are formed on the cloths with the area coverage ratio of 100%.

Next, if an image was printed, under the conditions of this example with the area coverage ratio of ink single dot being 90% and under the conditions of comparative example with the area coverage ratio being 100%, in which the mixed color solid print region of C ink and Y ink and the mixed color solid print region of M ink and Y ink are contiguous to each other, respectively, no blurs arose under the conditions of this example as shown in FIG. 13, but some blurs were confirmed in the comparative example as shown in FIG. 14.

(Example 2)

Figure 15A:
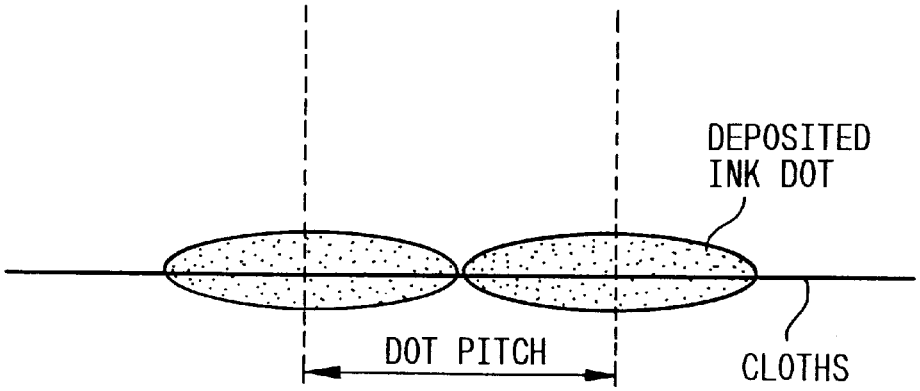
FIGS. 15A and 15B are typical views showing the states of ink droplets on the cloths before the fixation process in an example 2.
Figure 15B:
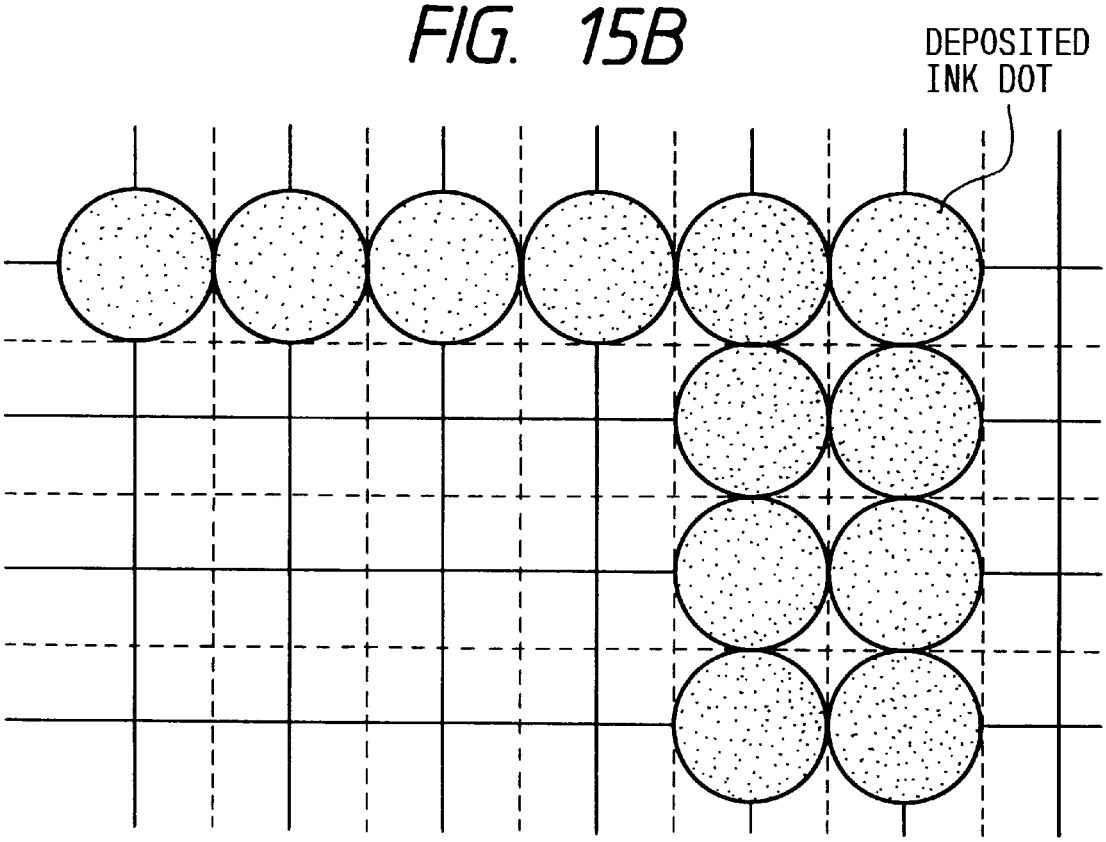
Figure 16A:
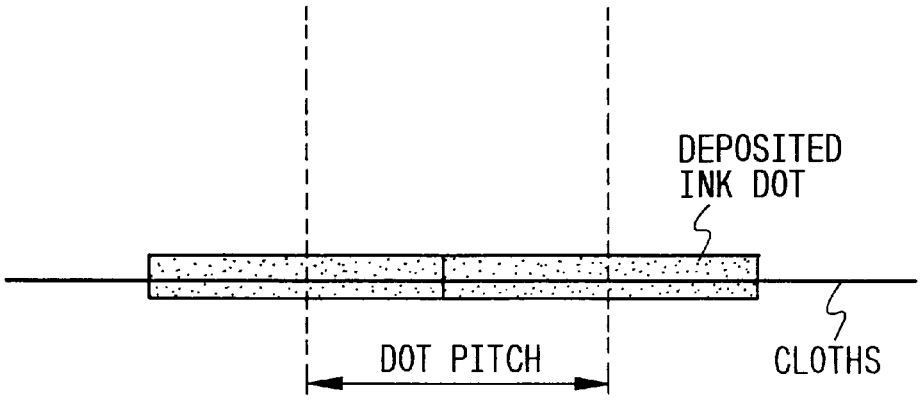
FIGS. 16A and 16B are typical views showing the states of ink droplets on the cloths after the fixation process in the example 2.
Figure 16B:
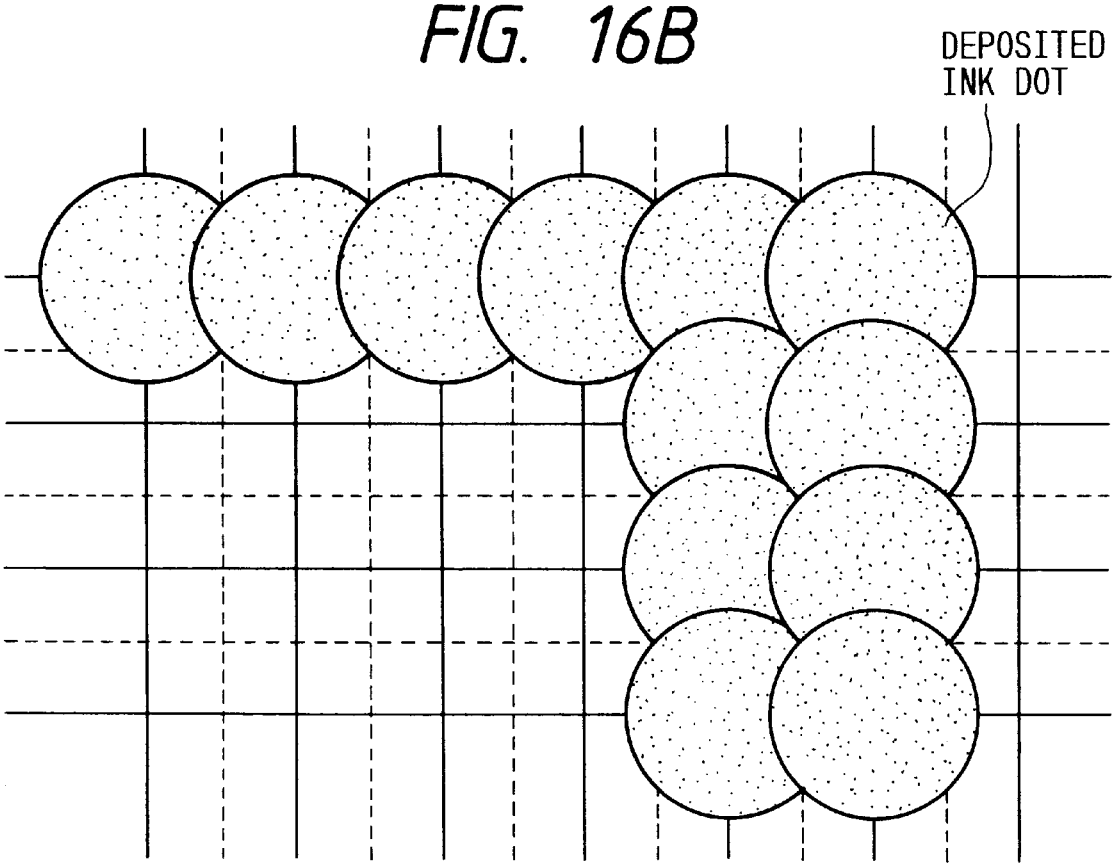

With the same print head as in the example 1 mounted on the ink jet printing unit as shown in FIG. 4, the printing was performed with the average discharge amount per discharge port being 30 pl. Then, it is expected that the print state can be obtained as shown in FIGS. 15A and 15B with less blurs as compared with the print state in the conventional example as typically shown in FIG. 1, and even after the fixation process such as the steaming, it is expected that an excellent printed product without blurs can be obtained as typically shown in FIGS. 16A and 16B.

Figure 17:
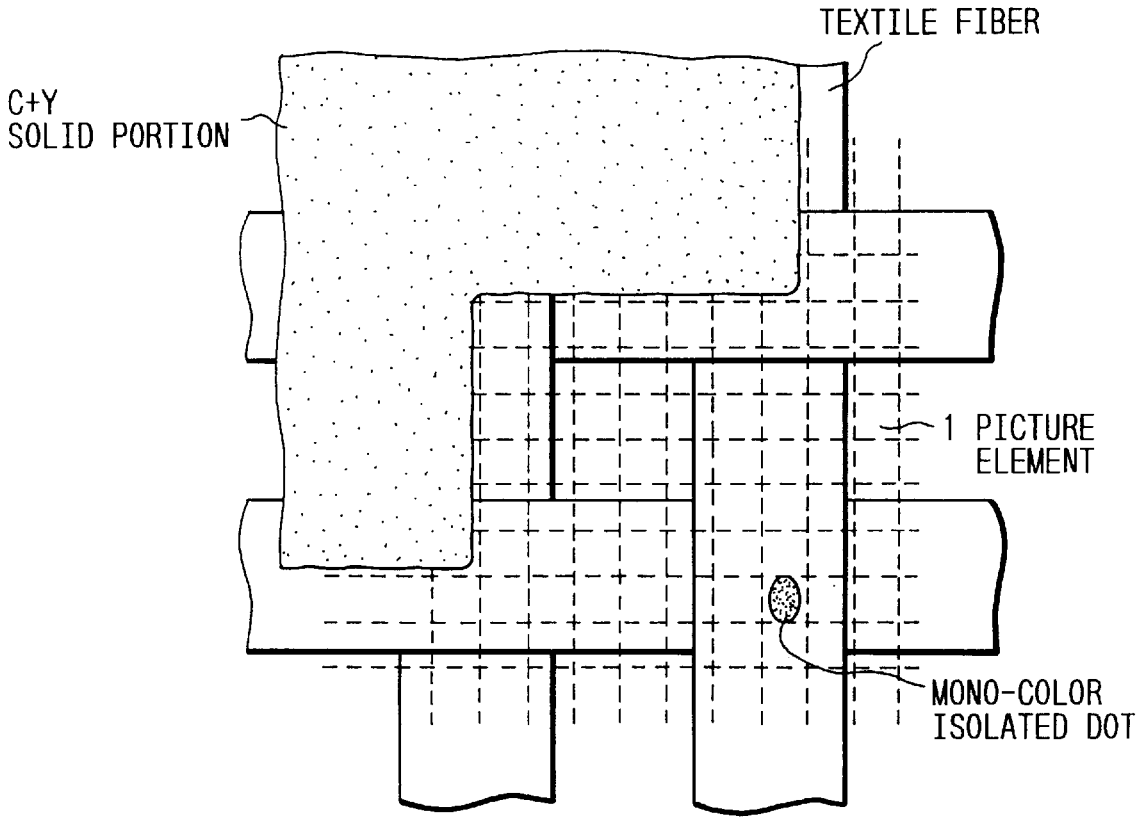
FIG. 17 is a view showing the state of an image formed on the cloths under the conditions of example 2 before the fixation.

If the same pattern as in FIG. 10 was formed using the same ink as in the example 1, an excellent printed result without blurs could be obtained, as shown in FIG. 17.

(Example 3)

Using an ink jet unit as shown in FIG. 4, and a recording head as previously described, an image was printed with the average discharge amount of 30 pl/nozzle. Then the ratio of single ink dot area to picture element area was 70%, and the dot diameter of attached ink had an average equivalent circle diameter for twenty single dots of 60 $\mu$m, which was smaller than the dot pitch, as shown in FIGS. 15A and 15B.

Herein, the equivalent circle diameter is a diameter of circle equivalent in the area value, and is also referred to as Heywood Diameter, which can be calculated by the following expression.

Equivalent circle diameter=$2\sqrt{(\text{dot area}/\pi)}$

Figure 18:
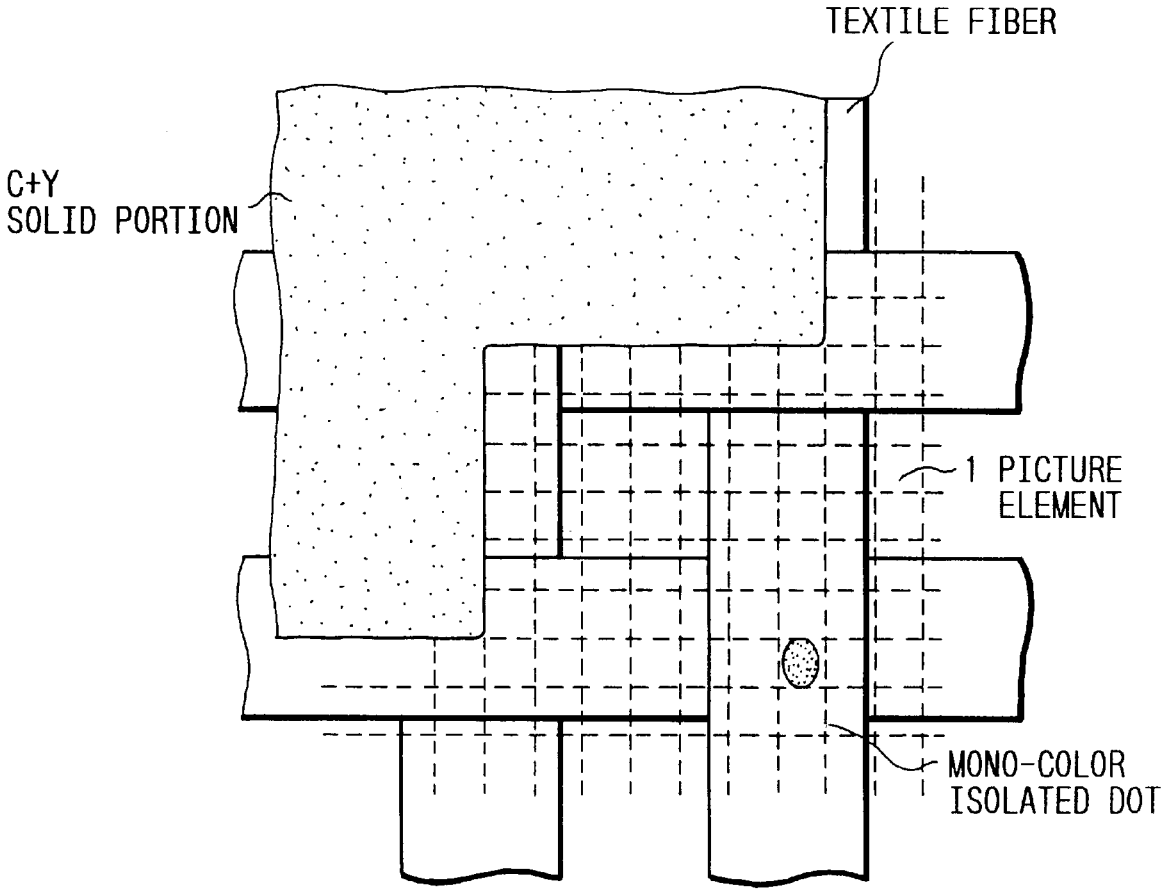
FIG. 18 is a view showing the state of the image formed on the cloths under the conditions of example 2 after the fixation.

As in the example 1, the fixation process such as steaming was performed, so that an image with extremely less blurs and having sufficient density could be obtained as shown in FIG. 18. And as in the example 1, the observation of the solid portion confirmed that the ink unattached portion existed before the steaming process, and the coloring was attained substantially over the entire region with no gap between adjacent dots, after the steaming process, as shown in FIG. 18.

Further, when an image as shown in FIG. 13 was printed under the conditions of this example, no blurs at the boundaries could be observed.

(Example 4)

The textile printing was performed in the same manner as in the example 1, except that the printing medium used each of cotton, silk, nylon, polyester, and synthetic fabrics impregnated with 10% aqueous solution of NaOH and subjected to blur prevention treatment, so that the same results as in the example 1 could be obtained.

(Example 5)

Using the same inks as in the example 1, the like image was printed complementarily by upper and lower two heads of the apparatus as shown in FIGS. 5 and 6. For this complementary printing, a sequential multi-scan method was used. This sequential multi-scan will be now described.

Figure 19:
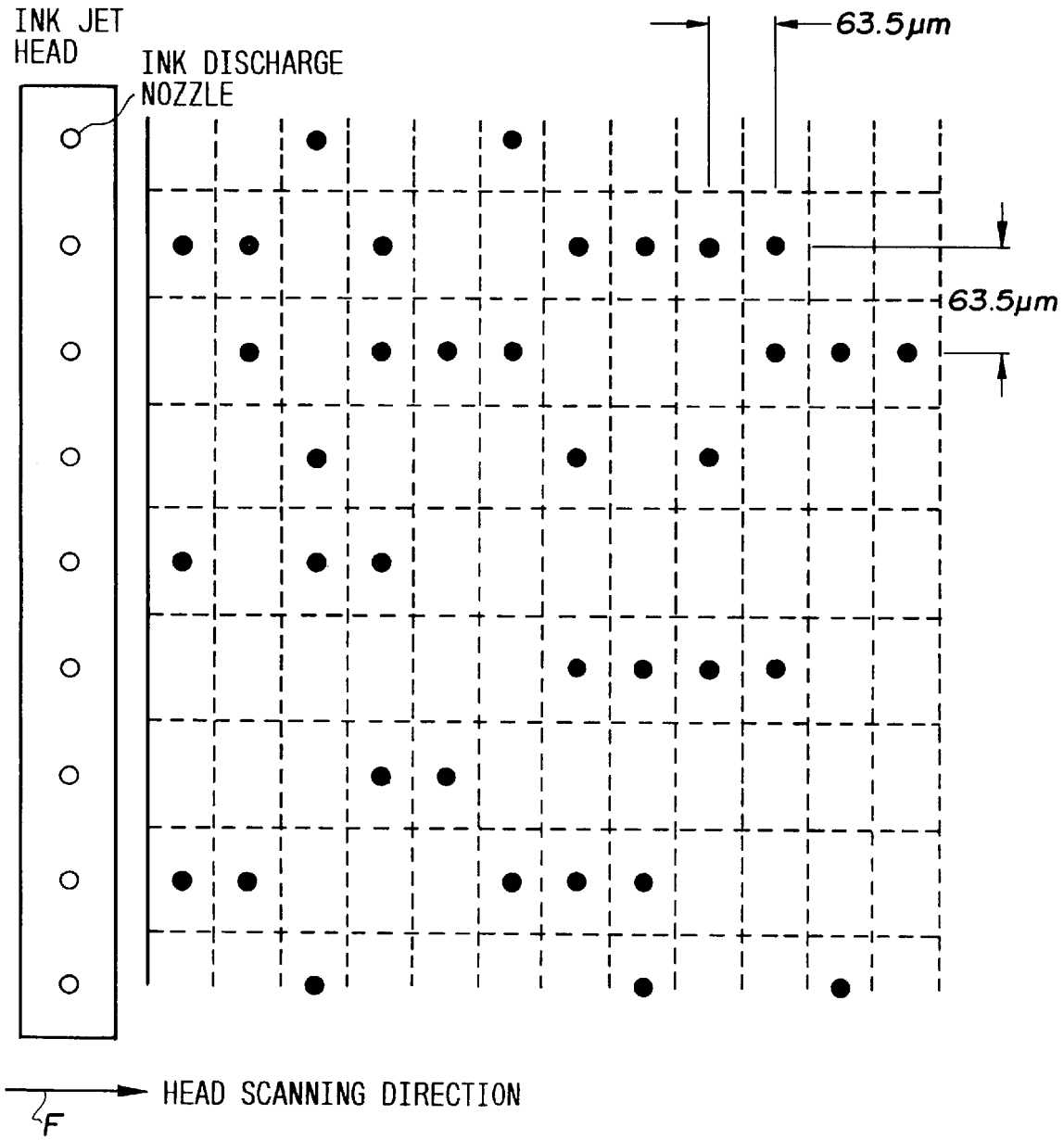
FIG. 19 is an explanation view for explaining the image formation for a print image in an example 4.

FIG. 19 is a view for explaining data printed by the sequential multi-scan.

In FIG. 19, each rectangular region surrounded by the dotted line corresponds to one dot (picture element), wherein if the print density is 400 dpi (dots/inch), the area of each rectangle is equal to about 63.5 $\mu m^2$, for example. It is supposed that the portion indicated by a black disk has an ink dot, and the portion without black disk is not printed. With the print head moving along the direction of the arrow F, the ink is discharged through ink discharge orifices at predetermined timings. This sequential multi-scan is made to correct for the dispersion in the density between each discharge port, which may be caused by the dispersion in the size of ink droplet discharged by each discharge port and the dispersion in the ink discharge direction, wherein the same line (in the head movement direction) is printed by a plurality of nozzles. By forming one line with a plurality of discharge ports in this way, unevenness in the density is reduced owing to the randomness in the characteristic of each discharge port for the print head. That is, when the sequential multi-scan with two scans is used, the printing is performed using a group of discharge ports for the upper half of the print head in the first scanning, and those for the lower half of the print head in the second scanning.

Figure 20:
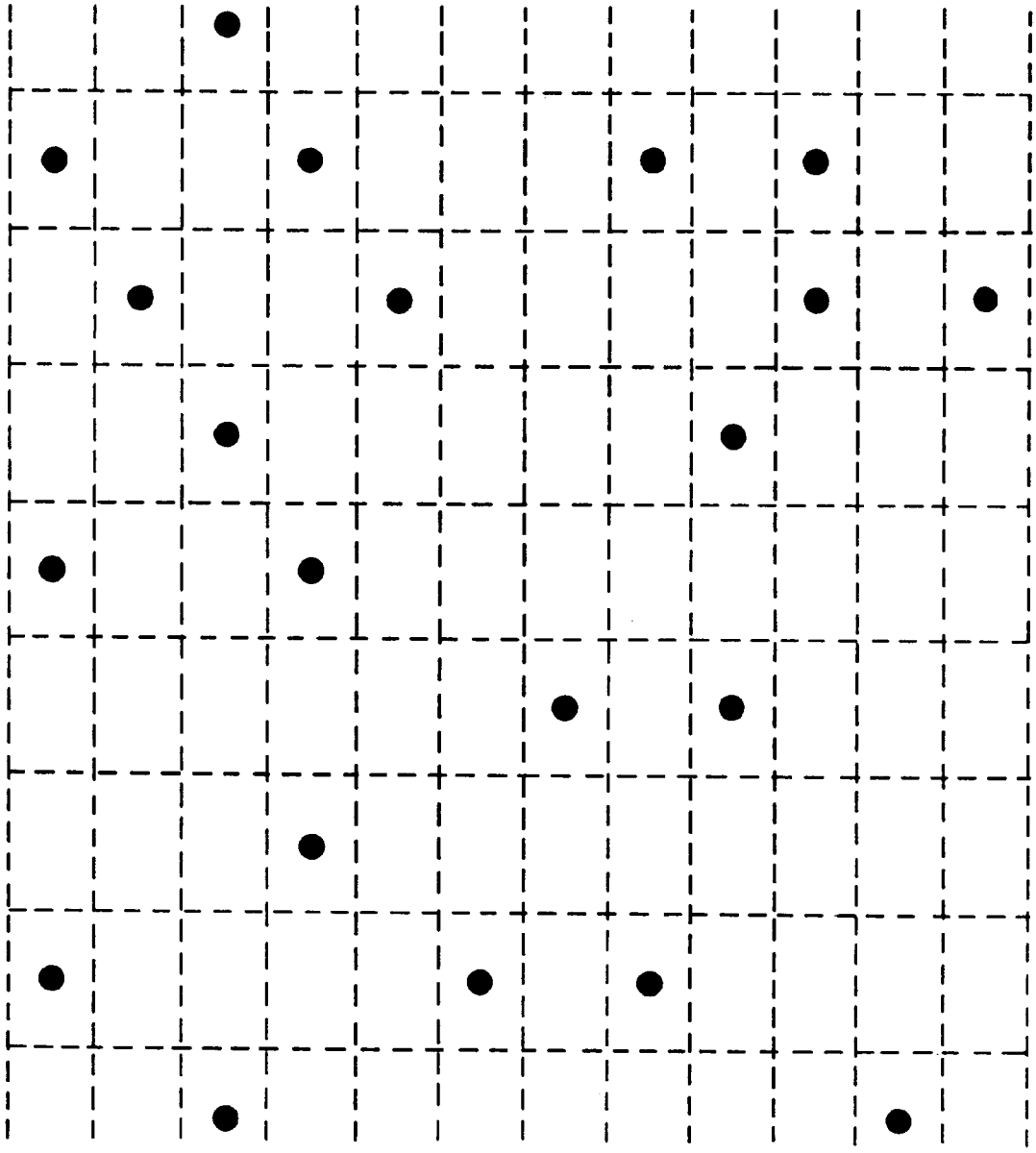
FIG. 20 is an explanation view for explaining the culling-out of data for the image of FIG. 19.
Figure 21:
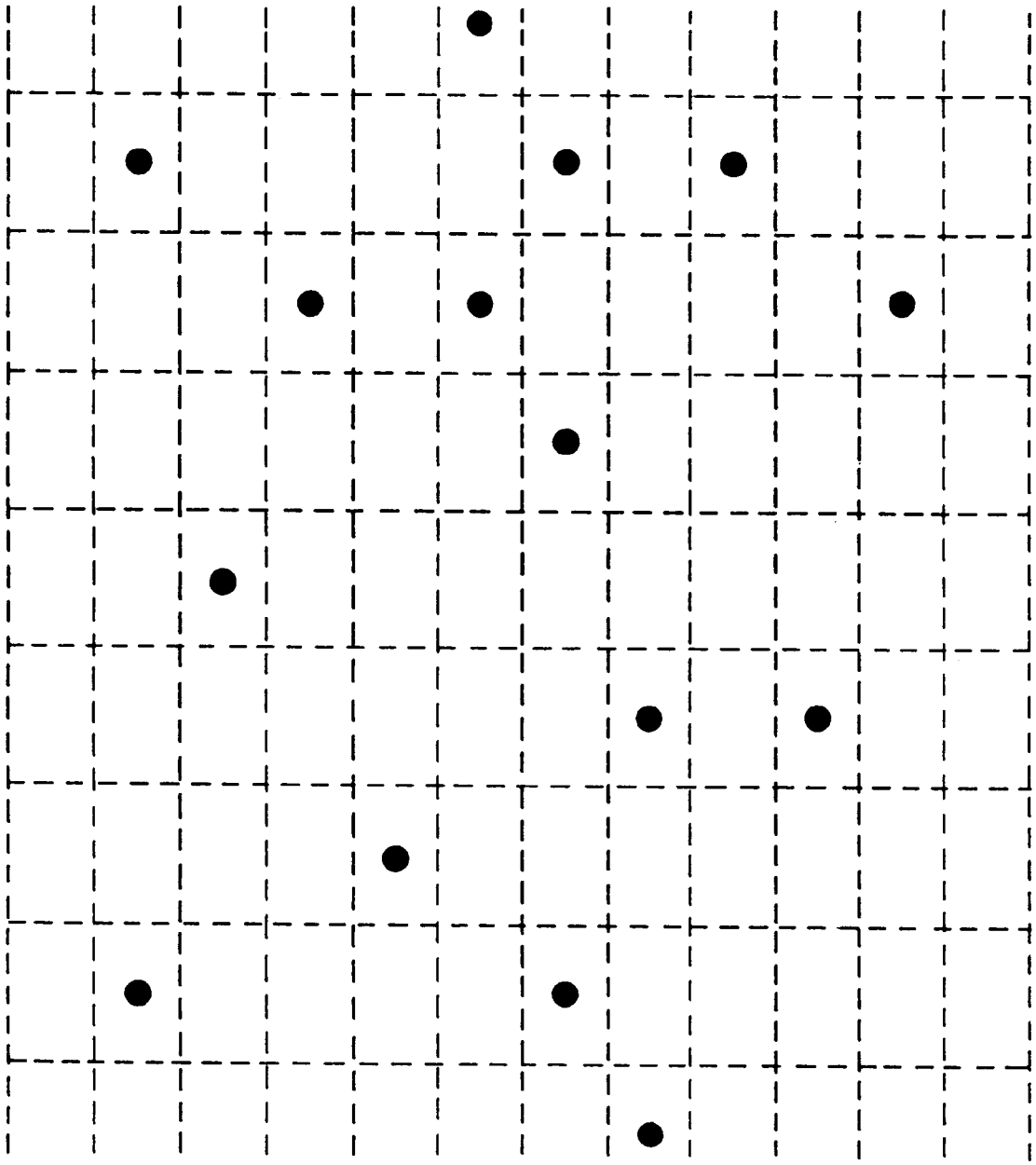
FIG. 21 is a similar explanation view.

Print examples with this sequential multi-scan are shown in FIGS. 20 and 21.

Now, when data as shown in FIG. 19 is printed, for example, only print data odd numbered in the data taking place along the movement direction of the print head is first printed by a group of discharge ports for the upper half of the print head, as shown in FIG. 20. Next, the print head (carriage) is returned toward the home position, and the cloths 36 is fed by one-half of the print head width. Thereafter, print data even numbered in the data taking place along the movement direction of the print head is secondly printed by a group of discharge ports for the lower half of the print head, as shown in FIG. 21. Thus, with these two scans, data as shown in FIG. 19 is printed on the cloths 36.

Figure 22:
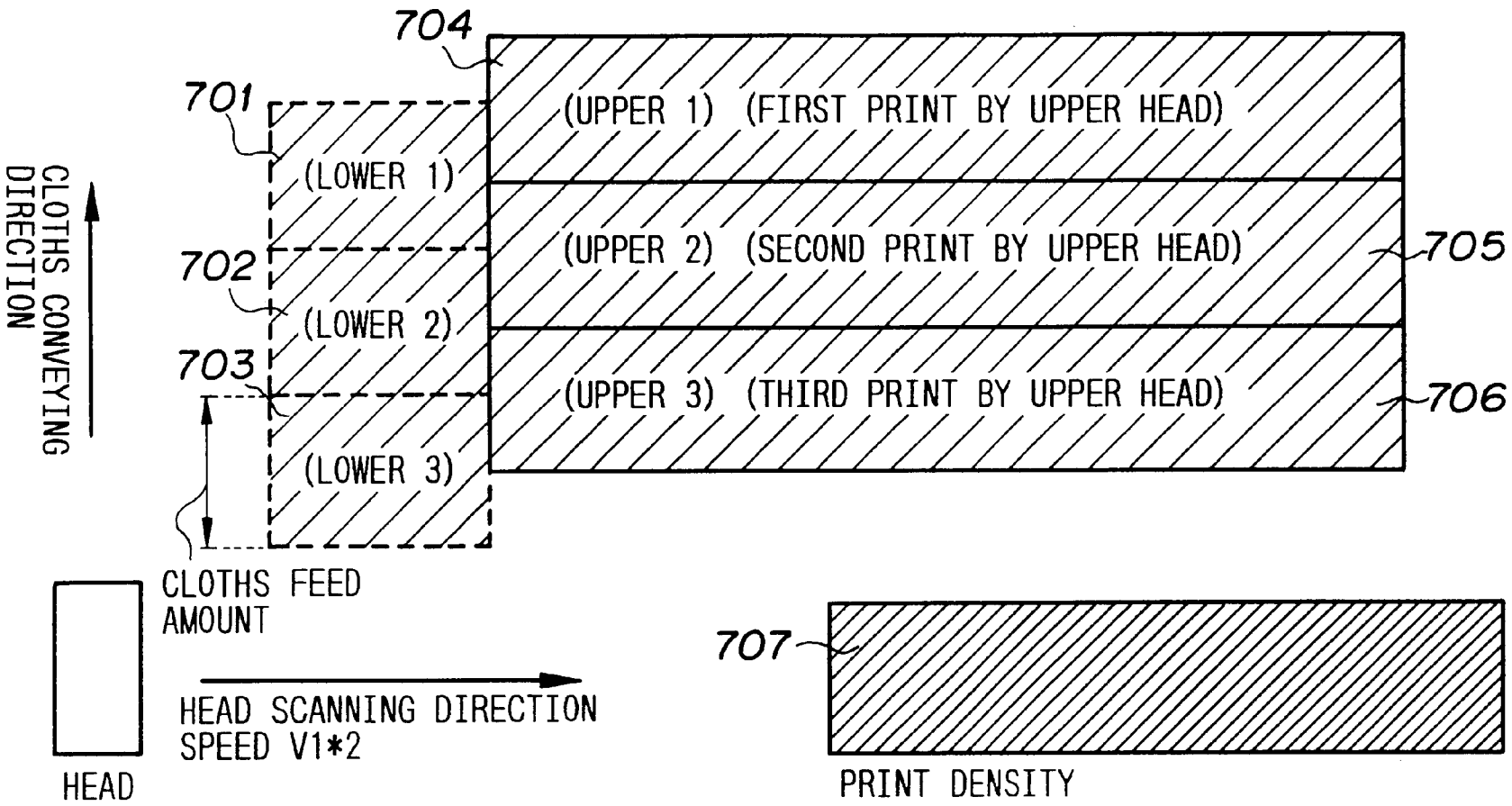
FIG. 22 is an explanation view for explaining an example of the printing method in the example 4.

FIG. 22 shows a print example of the normal multi-scan with two scans. The areas printed by the print head 9 of the first printing unit 31 are indicated by (Lower 1) 701, (Lower 2) 702, and (Lower 3) 703, and the areas printed by the print head 9' of the second printing unit 31' are indicated by (Upper 1) 704, (Upper 2) 705, and (Upper 3) 706.

The cloths conveying direction is as indicated by the arrow, the step feed amount of the cloths corresponding to a print width of the print head. As can be apparent from the FIG. 22, the whole print area has been printed by using either the upper half of the print head 9' of the second printing unit 311 and the lower half of the print head 9 of the first printing unit 31, or the lower half of the print head 9' of the second printing unit 31' and the upper half of the print head 9 of the first printing unit 31. Herein, data printed by each print head is culled out as shown in FIGS. 20 and 21, and the overlap printing by these two print heads 9, 9' results in a print density as indicated by 707.

If the same pattern as shown in FIG. 10 of the example 1 was printed complementarily, with the area coverage ratio of single dot being 90%, by using the upper and lower heads with such sequential multi-scan method, a more excellent print result in the fine line portion formed by color mixing was obtained. Also, if the same pattern as shown in FIG. 13 of the example 1 was printed, no blurs were seen at the boundaries at all. This is considered due to the fact that dots are culled out for the complementary printing by both the upper and lower heads, and during the time from the printing by the lower head to that by the upper head, the printed portion by the lower head is further dried.

(Example 6)

Using the same inks as in the example 1, like image was formed, using the apparatus as shown in FIG. 4 (apparatus 1) and the apparatus as shown in FIGS. 5 and 6 (apparatus 2). Then, the print heads having different discharge amounts were exchangeably used so that the area coverage ratio before the fixation of single ink dot might be variously changed. Evaluation results regarding the blur and the density after the fixation process for each of the area coverage ratios are listed in the following table.

TABLE 1

| Area coverage ratio | | Blur | Density |
|---|---|---|---|
| Apparatus 1 | 100% | bad | high |
| | 95% | slightly good | high |
| | 90% | good | high |
| | 60% | good | high |
| | 15% | good | medium |
| | 10% | good | low |
| Apparatus 2 | 100% | bad | high |
| | 95% | good | high |
| | 90% | good | high |
| | 60% | good | high |
| | 15% | good | medium |
| | 10% | good | low |

Herein, the area coverage ratio was obtained using the same image analysis system as in the example 1. That is, the area coverage ratio was obtained in the like manner as in the example 1. Note that the average coverage ratios in Table 1 are the average value for twenty single color dots.

As a result of various examinations in view of the results as listed in Table 1, it could be found that the lower limit of the area coverage ratio before the fixation was 15% or greater, preferably 40% or greater, and more preferably 60% or greater, and with the dot area coverage ratio after the fixation within a range from 70% to 100%, a clear image having sufficient density was obtained.

Several examples were presented above with respect to the area coverage ratio of single dot to one print picture element, but the present invention will be further described regarding the size of ink dot with respect to diameter of fibers making up the cloths as the printing medium, by way of specific example.

While in the examples as described below, an ink jet printing unit as shown in FIG. 4 is used, it will be understood that the upper and lower printing units as shown in FIGS. 5 and 6 may be used.

(Example 7)

Where an ink jet printing unit as shown in FIG. 4 is used, and a print head having heat energy converters for generating the heat energy given to the ink, and the 256 nozzles at 170 dpi, with the nozzle diameter or 40×40 $\mu$m for the nozzle of rectangular shape, is mounted, the ink is discharged onto the cloths at an average discharge amount of 240 pl/nozzle for the image printing. Herein, the cloths used is cotton (lawn) formed as the plain fabrics of textile fibers having an average diameter of 250 $\mu$m (the average value for twenty fibers) which has been immersed in an aqueous solution of sodium hydroxide having a concentration of 10%, then dried, and pre-treated.

Figure 23:
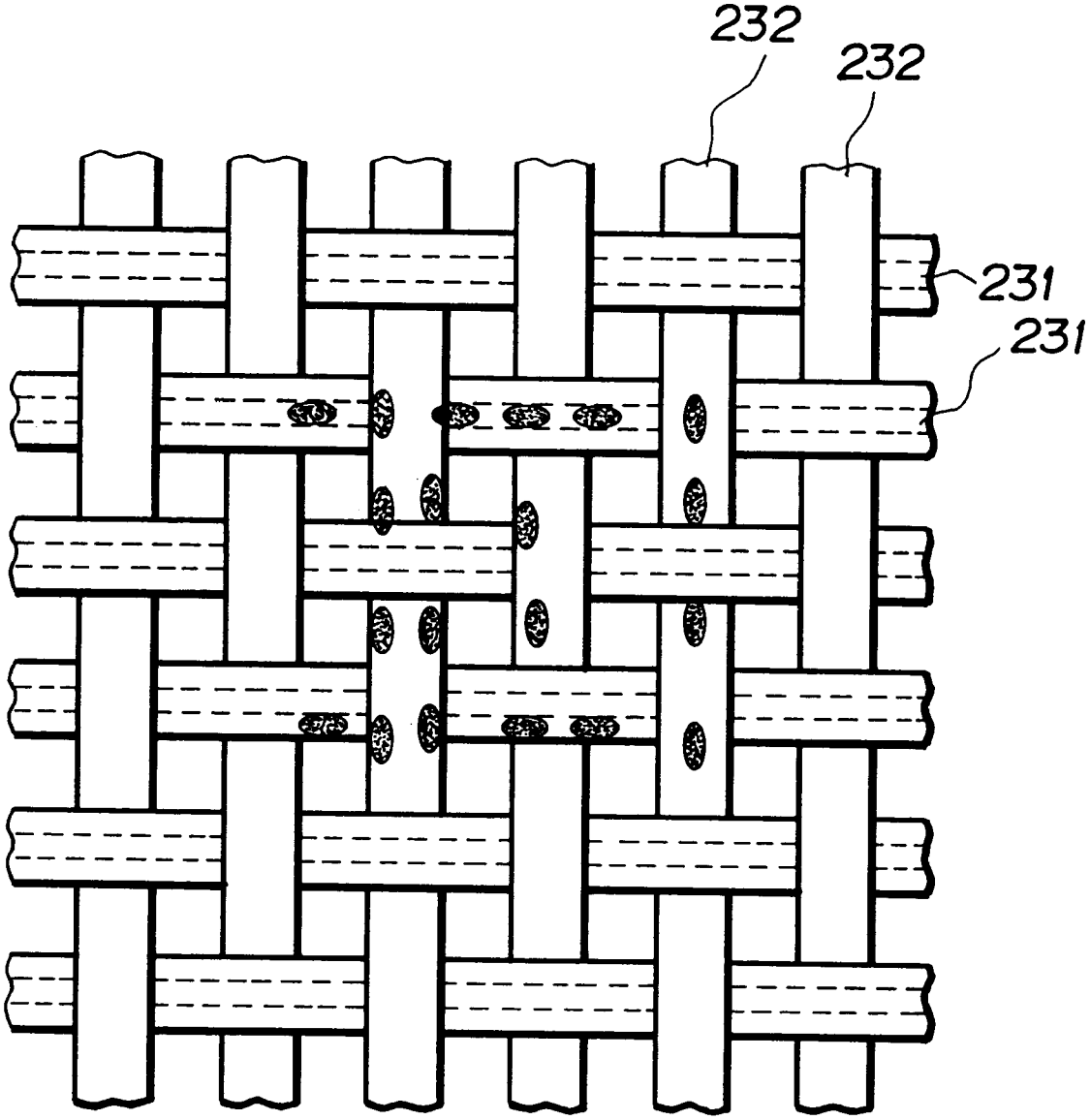
FIG. 23 is a view showing mono-color dot portions formed on the fibers in an example 7 on a larger scale.

Using the inks of four colors having the same constitution as in the example 1, the full color printing was performed. And after dot images were formed on the cloths, the ink fixation process and the washing process were conducted by the same well-known method as previously described. The result was observed by a microscope (60 time magnification). The observation of the region formed as mono-color dot in the highlight portion confirmed that there was a complete isolated dot on the fiber. The observed result is shown in FIG. 23. Herein, 231 is a weft and 232 is a warp. Note that the size of isolated dot is 200 $\mu$m in average length for the longest part, and 150 $\mu$m in average length for the shortest part. Also, the average value for the equivalent circle diameter for each dot (Heywood Diameter) was three-fourths the average value of fiber diameters as above noted. Note that the average diameter before the fixation process was 140 $\mu$m, and the area coverage ratio was about 70%.

The image quality thus obtained was excellent in the respects of resolution, blurring, reproducibility of highlight portion, and graininess.

Note that the measurement of the equivalent circle diameter for each dot was made using the same image analysis system as in the example 1.

Using the above system, a dot image was first stored in the image processing apparatus, a binarized dot shape was extracted, and the number of pixels read by CCD for the extracted portion was counted to be equal to 25400 pixels. Next, the total sum of pixels was converted into the actual area, the result of which was equal to 25400 $\mu m^2$ (1 $\mu$m for one side of one read pixel). Further, the diameter of equivalent circle was converted from this area, and the average value for obtained twenty numeric values was calculated to be equal to a value of 180 $\mu$m, which was equal to three-fourths the average value of the fiber diameters.

(Example 8)

Where an ink jet printing unit as shown in FIG. 4 is used, and a print head having heat energy converters for generating the heat energy given to the ink, and the 256 nozzles at 200 dpi, with the nozzle diameter of 40×40 $\mu$m for the nozzle of rectangular shape, is mounted, the ink is discharged onto the cloths at an average discharge amount of 200 pl/nozzle for the image printing. Herein, the cloths used are cotton (lawn) as in the example 7, and are subjected to additional treatment after image formation. The observation by a microscope (60 time magnification) for that result confirmed that there was a complete isolated dot on the fiber in the highlight portion as in the example 7. Note that the size of isolated dot was 180 μm in average length for the longest part, and 130 μm in average length for the shortest part. Also, the average value for the equivalent circle diameter for each dot measured as in the example 7 was 165 μm, or two-thirds the average value of fiber diameters as above noted. Note that the average dot diameter before the fixation process was 110 μm, and the area coverage ratio was about 65%.

The image quality thus obtained was excellent in the respects of resolution, blurring, reproducibility of highlight portion, and graininess.

Further, the like experiment was conducted on the cloths made of silk, nylon and polyester, so that the like results were obtained.

(Example 9)

Using a print head having thermal energy converters for generating the thermal energy given to the ink, and the 256 nozzles at 400 dpi, with the nozzle diameter of 22×33 μm for the nozzle of rectangular shape, the ink is discharged onto the cloths at an average discharge amount of 30 pl/nozzle, using the same inks as in the example 7, for the image printing. Herein, the cloths used are cotton (lawn) as the plain fabrics of textile fibers having an average diameter of 200 μm (average value for twenty values), and the like pre-treatment and additional treatment were conducted as in the example 7. The observation by a microscope (60 time magnification) for the printed result confirmed that there was a complete isolated dot on the fiber in the highlight portion as in the example 7, with the dot formed by color mixing of inks (1), (2) and (3) as shown in example 1. Note that the size of the isolated dot was 135 μm in average length for the longest part, and 100 μm in average length for the shortest part. Also, the average value for the equivalent circle diameter for each dot measured as in the example 7 was 120 μm, or three-fifths the average value of fiber diameters as above noted. Note that the average dot diameter before the fixation was 60 μm, and the area coverage ratio was 70%.

The image quality thus obtained was excellent in the respects of resolution, blurring, reproducibility of highlight portion, and graininess.

(Comparative Example)

Figure 24:
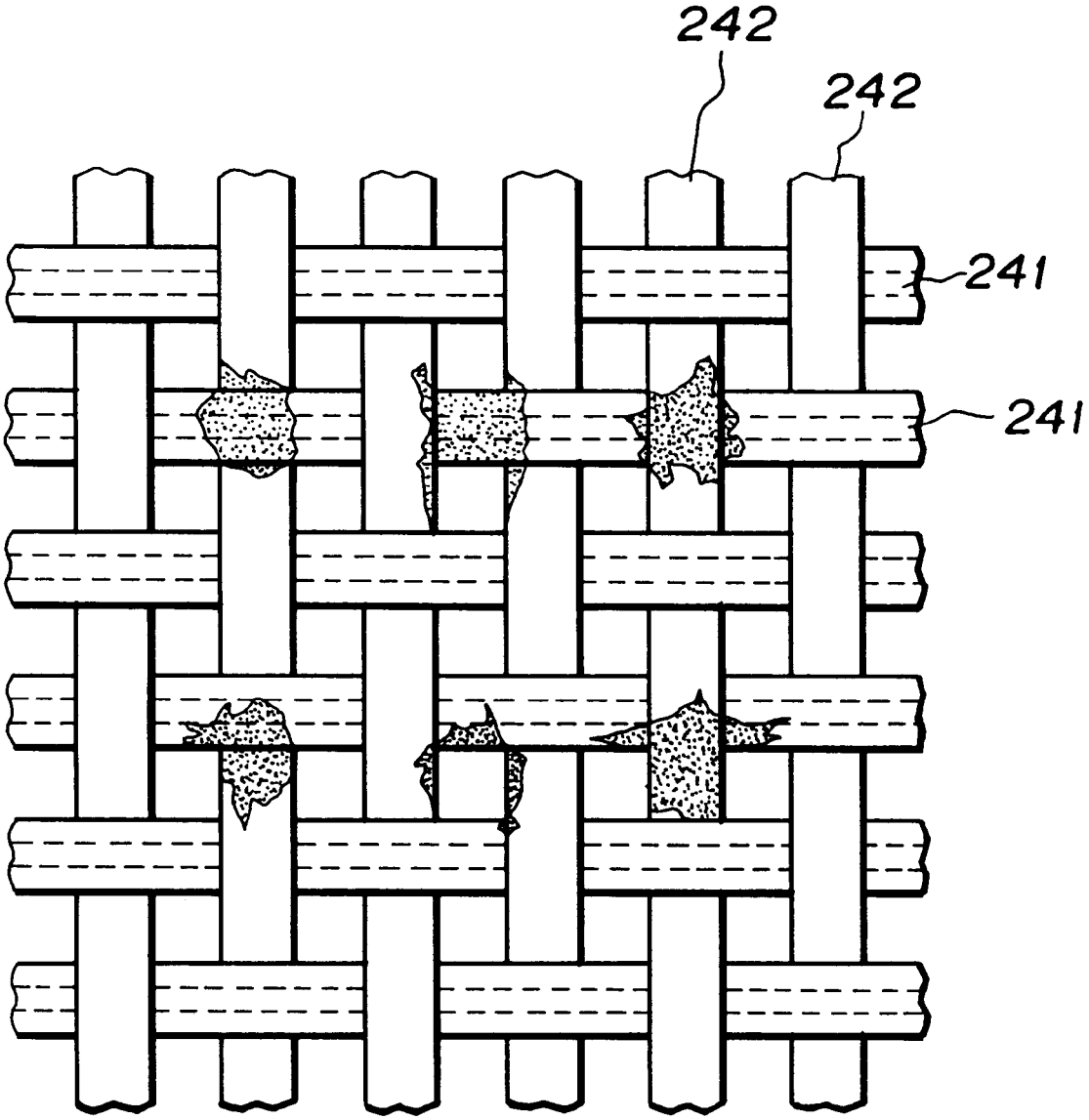
FIG. 24 is a view showing mono-color dot portions formed on the fibers in a comparative example on a larger scale.

Under the same conditions as in the example 7, the image was formed on the cloths made of cotton (lawn) formed as the plain fabrics of textile fibers having an average diameter of 150 μm (average value for twenty fibers). The observation by a microscope (60 time magnification) for that result showed that there was no complete isolated dot on the textile fiber of the cloths in mono-color dot portion. The observed result is shown in FIG. 24. Herein, 241 is a weft and 242 is a warp. As can be apparent from FIG. 24, the dot will extend across fibers and blurs occur particularly along the boundaries between overlapping fibers so as to present random shapes quite different from the shape of a circle or ellipse. The comparison of this image with the image obtained in the example 7 revealed that the character portion had blurs, with poorer graininess of dot, and the highlight portion had visible roughness.

Note that the average value of equivalent circle diameter for each dot measured as in the example 7 was six-fifths the average value of fiber diameters as previously noted. From the above examples and the comparative example, it could be found that when the average value of equivalent circle diameter for each dot is equal to three-fourths or less the average value of fiber diameters, there is the great improvement in the blurs in the character portion, the graininess of dot and the visual roughness. Also, it could be further found that when the average value of equivalent circle diameter is equal to two-thirds or less the average value of yarn diameter, or further three-fifths or less thereof, more preferable results can be obtained. Hence, the present invention has critical meanings in the scope of numeric values as above cited, and constitutes a numeric value limitation invention.

(Confirmation of Ink Attached State onto the Cloths)

Figure 25A:
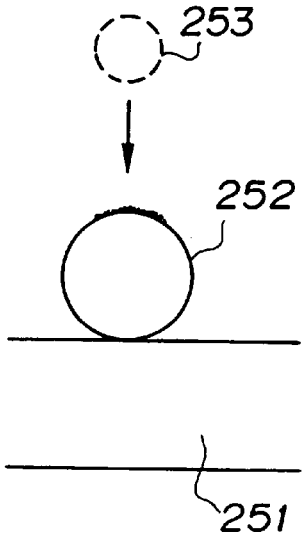
FIGS. 25A–25B, 26A–26B and 27A–27B are views showing the ink attaching states of a dot formed on the fiber in an example 7 as observed by using a microscope (100 magnifications) and the dot forming process.
Figure 26A:
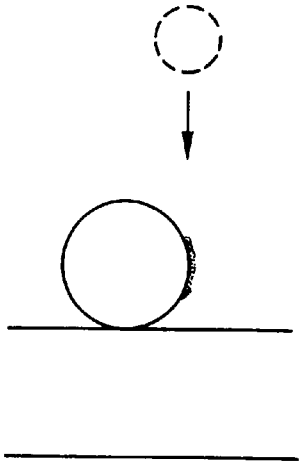
Figure 27A:
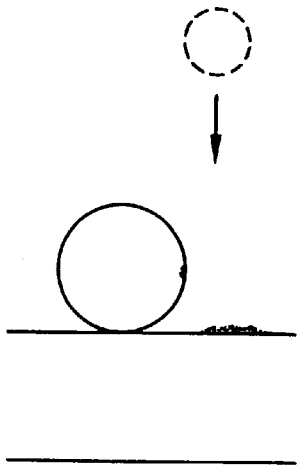
Figure 25B:
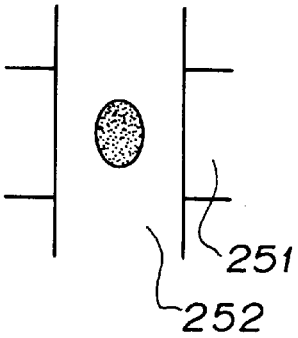
Figure 26B:
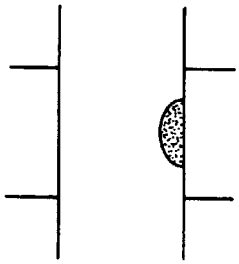
Figure 27B:
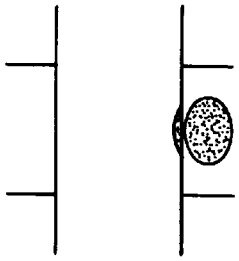

The observation by a microscope (100 magnifications) for the ink attached state of dot onto the cloths in the example 7 has revealed that the dot shape is as shown in FIGS. 25B, 26B and 27B. Herein, 251 is a weft and 252 is a warp, wherein FIGS. 25B, 26B and 27B are views of the overlapping state of weft and warp as viewed from the above. In FIGS. 25A–25B, 26A–26B and 27A–27B, the image having high resolution could be obtained, with less blurs of ink, no degradation in the graininess of dot, and no visual roughness. As a result of examination thereof, it could be revealed that such dot was formed through each step as shown in FIGS. 25A, 26A and 27A. FIGS. 25A, 26A and 27A are views of the states of FIGS. 25B, 26B and 27B as seen from the horizontal direction (cross-sectional direction). Herein, 253 is an ink particle discharged from the nozzle of head and toward the surface of the cloths.

That is, by attaching the ink onto the fiber at such a discharge amount that the average value of the length at the longest part of each dot after the printing is equal to three-fourths or less the average value of diameters of fibers constituting the cloths, it could be revealed that the ink attached at the boundary between warp 252 and weft 251 is introduced by a predetermined amount into a space portion 254 formed by the cross portion between warp 252 and weft 251, as shown in FIG. 26B. Therefore, it could be found that the high resolution was attained due to less blurs of ink, no degradation in the graininess of dot, and no visual roughness.

Figure 28A:
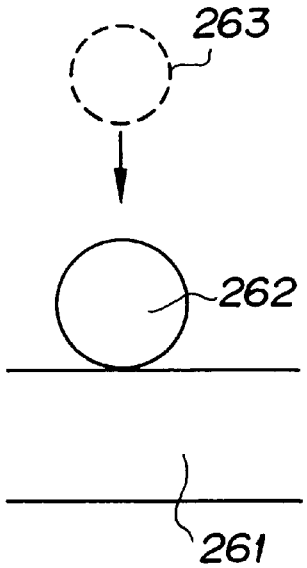
FIGS. 28A–28B, 29A–29B and 30A–30B are views showing the ink attaching states of a dot formed on the fiber in a comparative example as observed by using a microscope (100 magnifications) and the dot forming process.
Figure 29A:
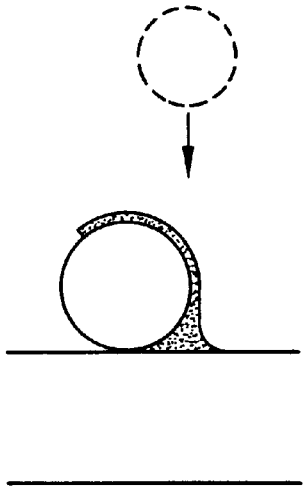
Figure 30A:
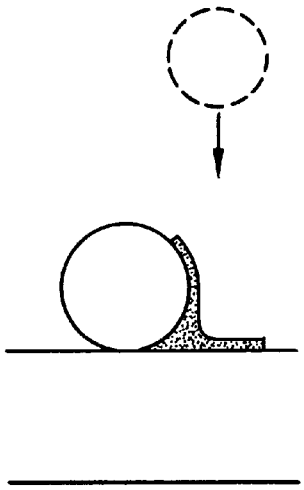
Figure 28B:
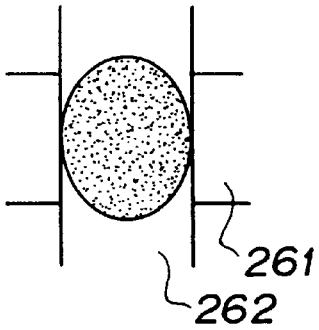
Figure 29B:
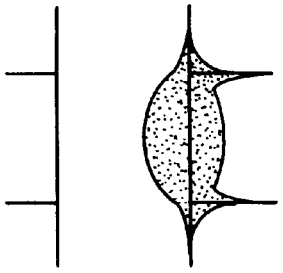
Figure 30B:
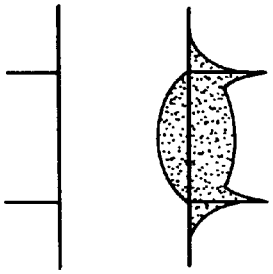

On the other hand, further observation by a microscope (100 time magnification) for the ink attached state of dot onto the fibers in the comparative example has revealed that the dot shape is as shown in FIGS. 28B, 29B and 30B. Herein, 261 is a weft and 262 is a warp, wherein FIGS. 28B, 29B and 30B are views of the overlapping state of weft and warp as seen from the above. The dot formed presented a random shape quite different from the shape of a circle or ellipse. Then, the image obtained had blurs of ink in the character portion, with poorer graininess of dot, and visual roughness in the highlight portion. As a result of examination thereof, it could be revealed that such dot was formed through each step as shown in FIGS. 28A, 29A and 30A. FIGS. 28A, 29A and 30A are views of the states of FIGS. 28B, 29B and 30B as seen from the horizontal direction. Herein, 263 is an ink particle dischaged from the nozzle of head and toward the surface of the cloths.

Since the ink is discharged onto the fibers at such a discharge amount that the average value of length at the longest part of each dot after the printing is equal to three-fourths or less the average value of diameters of fibers constituting the cloths in FIGS. 28A–28B, 29A–29B and 30A–30 B, it could be revealed that the ink attached particularly at the boundary between warp 262 and weft 261 can not be received into a space portion 264 formed between warp 262 and weft 261 and thus will overflow, as shown in, for example, FIGS. 29B and 30B. The overflowed ink may blur in the direction of each fiber of warp 262 and weft 261, and because the fiber directions of warp 262 and weft 261 are at right angles to each other, blurred ink will spread in shape in perpendicular directions, as shown in FIGS. 29B and 30B. As a result, it could be found that the dots present a random shape quite different from the shape of a circle or ellipse. Thus, the image at this time presented blurs of ink in the character portion, with poorer graininess of dot, and visual roughness in the highlight portion.

(Others)

The present invention brings about excellent effects particularly in using a print head of thermal jet system proposed by Canon Inc., which performs the printing by forming fine ink droplets by the use of thermal energy among the various ink jet printing systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), thermal energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging port, liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure waves of heat energy correspondent to the discharging portion.

Further, the recording head of the full line type having a length corresponding to the maximum width of a recording medium which can be recorded by the recording device may take either the constitution which satisfies its length by a combination of a plurality of recording heads as disclosed in the above specifications, or the constitution as one recording head integrally formed.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for-the recording head, capping means, cleaning means, pressurization or suction means, electricity-heat converters or another type of heating elements, or preliminary heating means according to a combination of these, and it is also effective for performing stable recording to perform a preliminary mode which performs discharging separate from recording.

Further, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

In either case, by using an ink jet textile printing apparatus system for representing image with dot patterns based on the digital image processing, the necessity for the continuous cloths having the same pattern repetitively drawn with the conventional textile printing methods is eliminated. That is, for the same continuous cloths, the patterns necessary for fabricating a variety of cloths are drawn contiguous to each other on the cloths, in accordance with the size and the shape, resulting in the least portion of the cloths not used when cut.

That is, it is possible to perform textile printing and cutting for the patterns contiguously arranged for use with quite different cloths which can not be conceived with the conventional textile printing methods.

Also, when the clothes different in size, scheduled number of products, type (design) or pattern, are printed contiguously on one sheet of cloth, it is possible to draw the cutting or sewing lines by using the same textile printing system, thereby resulting in higher fabrication efficiency.

Further, it is also possible to draw the cutting or sewing lines by digital image processing systematically and effectively, so that the alignment of patterns as sewed can be easily achieved Also, it is possible to design comprehensively whether the cutting direction is a texture direction or a bias direction, in accordance with the type or design, on the data processor, thereby making layout on the cloths.

Also, the cutting lines or the sewing lines can be drawn using a coloring matter which can be washed off after fabrication, unlike the dye for textile printing ink.

Since it is not necessary to the attached on the cloths at texture edges unnecessary for finished clothes, there is less wasteful consumption of the ink.

Note that the preferable inks for use with the present invention can be adjusted as follows.

| | | |
|---|---|---|
| (1) | Reactive dye (C.I. Reactive Yellow 95) | 10 parts by weight |
| | Thiodiglycol | 10 parts by weight |
| | Diethylene glycol | 20 parts by weight |
| | Water | 60 parts by weight |

With all the constituents as above cited mixed, the solution is agitated for one hour, and after adjusting pH to pH7 by NaOH, agitated for two hours, and filtered through a Phloropore filter FP-100 (trade name, made by Sumitomo Electric), whereby the ink is obtained.

| | | |
|---|---|---|
| (2) | Reactive dye (C.I. Reactive Red 24) | 10 parts by weight |
| | Thiodiglycol | 15 parts by weight |
| | Diethylene glycol | 10 parts by weight |
| | Water | 60 parts by weight |

The ink is then prepared in the same way as in (1).

| | | |
|---|---|---|
| (3) | Reactive dye (C.I. Reactive Blue 72) | 8 parts by weight |
| | Thiodiglycol | 25 parts by weight |
| | Water | 67 parts by weight |

The ink is then prepared in the same way as in (1).

| | | |
|---|---|---|
| (4) | Reactive dye (C.I. Reactive Blue 49) | 12 parts by weight |
| | Thiodiglycol | 25 parts by weight |
| | Water | 63 parts by weight |

The ink is then prepared in the same way as in (1).

| | | |
|---|---|---|
| (5) | Reactive dye (C.I. Reactive Black 39) | 10 parts by weight |
| | Thiodiglycol | 15 parts by weight |
| | Diethylene glycol | 15 parts by weight |
| | Water | 60 parts by weight |

The ink is then prepared in the same way as in (1).

As above detailed, according to the present invention, the ink is discharged from the print head to be attached onto the printing medium such as the cloths, and in forming an image from a number of dots thus obtained, the ink amount discharged from the print head onto the printing medium is appropriately set so that the area coverage ratio of single dot before the fixation may be less than 100%, or the average value of equivalent circle diameter for each dot after the fixation may be three-fourths or less the average value of diameters of fibers constituting the cloths, whereby blurring is reduced particularly at the boundaries of overlapping fibers, with high graininess of dot, thereby giving rise to the effect that ink jet printed products having high image quality can be obtained.

What is claimed is:

1. An apparatus for forming ink jet printed products, the ink jet printed products being processed by fixing means for effecting a fixing process after ink jet printing so that coloring matter contained in ink is fixed to a printing medium, said apparatus comprising:

means for printing onto a printing medium, said printing means comprising a print head having discharge ports for discharge of ink; and control means for controlling said printing means such that in printing, an ink dot formed in a discharging operation through one of the discharge ports has an area coverage ratio of less than 100% relative to an area of a corresponding print picture element before the ink is fixed to the printing medium, said control means controlling said printing means to form a plurality of ink dots on the printing medium, wherein before the fixing process, the plurality of ink dots enclose a central portion to which ink is not applied in an image area where all picture elements are applied with ink among images formed, such that the central portion is covered with ink after the fixing process.

2. An apparatus according to claim 1, wherein said apparatus is provided in an industrial printing apparatus for effecting large-scale industrial printing.

3. An apparatus according to claim 1, wherein said printing means comprises a plurality of print heads for color mixing printing using inks having different color tones, wherein for each of said plurality of print heads provided corresponding to the inks having different color tones, the ink dot has an area coverage ratio of less than 100% relative to the area of the corresponding print picture element.

4. An apparatus according to claim 1, wherein a diameter of the ink dot before fixation is smaller than a pitch between adjacent picture elements.

5. An apparatus according to claim 1, further comprising means for conveying the printing medium with respect to said printing means in a conveying direction, wherein the ink dot is formed complementarily by first and second print heads spaced apart in the conveying direction.

6. An apparatus according to claim 1, further comprising a drying station, wherein drying is effected at said drying station at a conveying passage between first and second print heads.

7. An apparatus according to claim 1, wherein the print head comprises thermal energy converters for generating thermal energy causing film boiling in the ink, as the energy for the discharge of inks.

8. An apparatus according to claim 1, further comprising washing means for washing the printing medium after fixation.

9. An apparatus according to claim 1, further comprising means for inputting a pretreatment agent in the print medium prior to printing by said printing means.

10. An apparatus according to claim 1, wherein the printing medium comprises cloths, onto which textile printing is performed.

11. An apparatus according to claim 1, further comprising fixing means for fixing in the fixing process a coloring matter contained in the ink to the printing medium.

12. An apparatus according to claim 1, wherein the area coverage ratio is 15–100%.

13. An apparatus according to claim 1, wherein when the coloring matter is fixed to the printing medium, the coloring matter cannot be removed by rinsing.

14. An apparatus according to claim 1, further comprising means for conveying the printing medium with respect to said printing means in a conveying direction.

15. An apparatus for forming ink jet printed products, the ink jet printed products being processed by fixing means for effecting a fixing process after ink jet printing so that coloring matter contained in ink is fixed to a printing medium, said apparatus comprising:

means for performing printing onto a printing medium, said printing means comprising a print head having discharge ports for discharge of ink; and control means for controlling said printing means in printing such that the average value of an equivalent circle diameter of an ink dot formed at one time in a discharging operation through one of the discharge ports is three-fourths or less the average width of fibers constituting the printing medium after a coloring matter contained in the ink is fixed to the printing medium, the equivalent circle diameter for each ink dot being the diameter of a circle having an area equal to the area of the ink dot.

16. An apparatus according to claim 15, wherein said apparatus provided in an industrial printing apparatus for effecting large-scale industrial printing.

17. An apparatus according to claim 15, wherein said printing means comprises a plurality of print heads for color mixing printing using inks having different color tones, wherein for each of said plurality of print heads provided corresponding to the inks having different color tones, the average value of the equivalent circle diameter of the ink dot is three-fourths or less the average width of the fibers.

18. An apparatus according to claim 15, further comprising means for conveying the printing medium with respect to said printing means in a conveying direction, wherein the ink dot is formed complementarily by first and second print heads spaced apart in the conveying direction.

19. An apparatus according to claim 15, further comprising a drying station, wherein drying is effected at said drying station at a conveying passage between first and second print heads.

20. An apparatus according to claim 15, wherein the print head comprises thermal energy converters for generating thermal energy causing film boiling in the ink, as the energy for the discharge of inks.

21. An apparatus according to claim 15, further comprising washing means for washing the printing medium after fixation.

22. An apparatus according to claim 15, further comprising means for inputting a pretreatment agent in the print medium prior to printing by said printing means.

23. An apparatus according to claim 15, wherein the printing medium comprises cloths, onto which textile printing is performed.

24. An apparatus according to claim 15, further comprising fixing means for fixing a coloring matter contained in the ink to the printing medium.

25. An apparatus according to claim 15, wherein when the coloring matter is fixed to the printing medium, the coloring matter cannot be removed by rinsing.

26. An apparatus according to claim 15, further comprising means for conveying the printing medium with respect to said print head in a conveying direction.

27. An apparatus according to claim 15, wherein the average value of the equivalent circle diameter is two-thirds of or less than the average width of the fibers.

28. An apparatus according to claim 15, wherein the average value of the equivalent circle diameter is three-fifths of or less than the average width of the fibers.

29. A method for forming ink jet printed products, said method comprising the steps of:

attaching ink onto a printing medium using a print head having discharge ports for discharge of the ink; and fixing the ink onto the printing medium, wherein in said attaching step, the ink is discharged so that an ink dot formed in a discharging operation through one of the discharge ports has an area coverage ratio of less than 100% relative to an area of a corresponding print picture element before said fixing step and a plurality of ink dots are formed with plural ink dots before said fixing step, the plurality of ink dots enclose a central portion to which ink is not applied in an image area where all picture elements are applied with ink among images formed, such that the central portion is covered with ink after said fixing step.

30. A method according to claim 29, wherein components used in said method are for effecting large-scale industrial printing.

31. A method according to claim 29, wherein said attaching step utilizes a plurality of print heads to perform color mixing printing using inks having different color tones, wherein for each of said plurality of print heads provided corresponding to the inks having different color tones, the ink dot has an area coverage ratio of less than 100% relative to the area of the corresponding print picture element.

32. A method according to claim 29, wherein the discharge is performed so that a diameter of the ink dot before said fixing step is smaller than a pitch between adjacent picture elements.

33. A method according to claim 29, further comprising the step of conveying the printing medium with respect to the printing means in a conveying direction, wherein the ink dot is formed complementarily by first and second print heads spaced apart in the conveying direction.

34. A method according to claim 29, further comprising a drying step, wherein drying is effected at a conveying passage between first and second print heads.

35. A method according to claim 29, wherein the print head comprises thermal energy converters for generating thermal energy causing film boiling in the ink, as the energy for the discharge of inks.

36. A method according to claim 29, further comprising a washing step for washing the printing medium after said fixing step.

37. A method according to claim 29, further including the step of inputting a pretreatment agent in the print medium prior to printing by the print head.

38. A method according to claim 29, wherein the printing medium comprises cloths, onto which textile printing is performed.

39. A method according to claim 29, wherein the area coverage ratio is 15–100%.

40. A method according to claim 29, wherein when the coloring matter is fixed to the printing medium, the coloring matter cannot be removed by rinsing.

41. A method for forming ink jet printed products, said method comprising the steps of:

attaching ink onto a printing medium using a print head having discharge ports for discharge of ink; and fixing a coloring matter contained in the ink to the printing medium, wherein ink is discharged such that an average value of an equivalent circle diameter of an ink dot formed in a discharging operation through one of the discharge ports is three-fourths or less an average width of fibers making up the printing medium after said fixing step, the equivalent circle diameter for each ink dot being the diameter of a circle having an area equal to the area of the ink dot.

42. A method according to claim 41, wherein components used in said method are for effecting large-scale industrial printing.

43. A method according to claim 41, wherein said attaching step utilizes a plurality of print heads to perform color mixing printing using inks having different color tones, wherein for each of said plurality of print heads provided corresponding to the inks having different color tones, the average value of the equivalent circle diameter of the ink dot is three-fourths or less the average value of the fiber diameters.

44. A method according to claim 41, comprising the step of conveying the printing medium with respect to the printing means in a conveying direction, wherein the ink dot is formed complementarily by first and second print heads spaced apart in the conveying direction.

45. A method according to claim 44, further comprising a drying step, wherein drying is effected at a conveying passage between first and second print heads.

46. A method according to claim 41, wherein the print head comprises thermal energy converters for generating thermal energy causing film boiling in the ink, as the energy for the discharge of inks.

47. A method according to claim 41, further comprising a washing step for washing the printing medium after said fixing step.

48. A method according to claim 41, further including the step of inputting a pretreatment agent in the print medium prior to printing by the print head.

49. A method according to claim 41, wherein the printing medium comprises cloths, onto which textile printing is performed.

50. A method according to claim 41, wherein when the coloring matter is fixed to the printing medium, the coloring matter cannot be removed by rinsing.

51. A method according to claim 41, wherein the average value of the equivalent circle diameter is two-thirds of or less than the average width of the fibers.

52. A method according to claim 41, wherein the average value of the equivalent circle diameter is three-fifths of or less than the average width of the fibers.

53. An ink jet textile printing apparatus for printing on a textile recording medium to form ink jet printed textile products, for use with an ink jet recording means for recording on said textile recording medium over a recording region by forming a plurality of ink dots thereon, said ink jet recording means comprising a plurality of discharge ports, each said ink dot being formed by an associated discharge port, said ink jet recording means forming said ink dots from a recording fluid, the ink jet printed textile products being Processed by fixing means for effecting a fixing process after ink jet printing so that a coloring agent contained in ink is fixed to the textile recording medium, said apparatus comprising:

means for mounting said ink jet recording means; and control means for controlling said ink jet recording means so that said ink dots formed in a single discharge operation each have an area coverage ratio which is less than 100% of an area of a corresponding print picture element before fixation of a coloring agent to said textile recording medium in the fixing process, said control means controlling said ink jet recording means to form a plurality of ink dots on the ink jet recording medium, wherein before fixation, the plurality of ink dots enclose a central portion to which ink is not applied in an image area where all picture elements are applied with ink among images formed such that the central portion is covered with ink after the fixing process.

54. An ink jet textile printing apparatus according to claim 53, wherein said ink comprises a solvent, and further comprising:

drying means for drying said textile recording medium following printing by said ink jet recording means, said drying means reducing an amount of said solvent in said ink dots.

55. An ink jet textile printing apparatus according to claim 54, wherein said drying means comprises an elongated heating body disposed adjacent to said recording region, said textile recording medium passing between said ink jet recording means and said drying means.

56. An ink jet textile printing apparatus according to claim 54, wherein said drying means comprises an elongated member having a first duct and a second duct, said first duct and said second duct each having a vent structure which allows gas flow therethrough.

57. An ink jet textile printing apparatus according to claim 56, wherein said first duct conveys heated gas, and said heated gas flows out through said vent structure toward said textile recording medium.

58. An ink jet textile printing apparatus according to claim 56, wherein said first duct conveys dry gas, and said dry gas flows out through said vent structure toward said textile recording medium.

59. An ink jet textile printing apparatus according to claim 56, wherein said second duct conveys gas flowing from said textile recording medium through said vent structure into said second duct.

60. An ink jet textile printing apparatus according to one of claims 53 or 56, wherein said ink jet recording means comprises:

a first ink jet head; and a second ink jet head, and when said ink jet textile printing apparatus prints a linear image comprising a line of a plurality of successive and adjacent pixels, said first ink jet head prints a first group of some of said pixels, and said second ink jet head prints a second group of other said pixels, so that for each given said pixel recorded by said first ink jet head, said pixels which are immediately adjacent thereto are recorded by said second ink jet head.

61. An ink jet textile printing apparatus according to claim 53, further comprising textile recording medium supply means for supplying said textile recording medium.

62. An ink jet textile printing apparatus according to claim 61, further comprising textile recording medium collection means for collecting said textile recording medium following recording.

63. An ink jet textile printing apparatus according to claim 62, further comprising textile recording medium conveying means for conveying said textile recording medium from said textile recording medium supply means to said textile recording medium collection means.

64. An ink jet textile printing apparatus according to claim 53, further comprising said ink jet recording means.

65. A printing apparatus according to claim 53, wherein the area coverage ratio is 15–100%.

66. A printing apparatus according to claim 53, wherein when the coloring agent is fixed to the recording medium, the coloring agent cannot be removed by rinsing.

67. An ink jet textile printing apparatus according to claim 53, further comprising means for conveying the recording medium with respect to said recording means in a conveying direction.

68. An ink jet textile printing apparatus for printing on a textile recording medium to form ink jet printed textile products, for use with an ink jet recording means for recording on said textile recording medium over a recording region by forming a plurality of ink dots thereon, said ink jet recording means comprising a plurality of discharge ports, each said ink dot being formed by an associated said discharge port, said ink jet recording means forming said ink dots from a recording fluid, and said textile recording medium having a plurality of fibers, said fibers having an average fiber width, the ink jet printed textile products being Processed by fixing means for effecting a fixing process after ink jet printing so that a coloring agent contained in ink is fixed to the textile recording medium, said apparatus comprising:

means for mounting said ink jet recording means; and control means for controlling said ink jet recording means so that after fixation in the fixing process, an average value of an equivalent circle diameter of a given ink dot formed in a single discharge operation through a single discharge port is not more than three-fourths of the average fiber width, the equivalent circle diameter for each ink dot being the diameter of a circle having an area equal to the area of the ink dot.

69. An ink jet textile printing apparatus according to claim 68, wherein said ink comprises a solvent, and further comprising:

drying means for drying said textile recording medium following recording by said ink jet recording means, said drying means reducing an amount of said solvent in said ink dots.

70. An ink jet textile printing apparatus according to claim 69, wherein said drying means comprises an elongated heating body disposed adjacent to said recording region, said textile recording medium passing between said ink jet recording means and said drying means.

71. An ink jet textile printing apparatus according to claim 69, wherein said drying means comprises an elongated member having a first duct and a second duct, said first duct and said second duct each having a vent structure which allows gas flow therethrough.

72. An ink jet textile printing apparatus according to claim 71, wherein said first duct conveys heated gas, and said heated gas flows out through said vent structure toward said textile recording medium.

73. An ink jet textile printing apparatus according to claim 71, wherein said first duct conveys dry gas, and said dry gas flows out through said vent structure toward said textile recording medium.

74. An ink jet textile printing apparatus according to claim 71, wherein said second duct conveys gas flowing from said textile recording medium through said vent structure into said second duct.

75. An ink jet textile printing apparatus according to any one of claims 68 and 71, wherein said ink jet recording means comprises:

a first ink jet head; and a second ink jet head, and when said ink jet textile printing apparatus prints a linear image comprising a line of a plurality of successive and adjacent pixels, said first ink jet head prints a first group of some of said pixels, and said second ink jet head prints a second group of other said pixels, so that for each given said pixel recorded by said first ink jet head, said pixels which are immediately adjacent thereto are recorded by said second ink jet head.

76. An ink jet textile printing apparatus according to claim 68, further comprising textile recording medium supply means for supplying said textile recording medium.

77. An ink jet textile printing apparatus according to claim 76, further comprising textile recording medium collection means for collecting said textile recording medium following recording.

78. An ink jet textile printing apparatus according to claim 77, further comprising textile recording medium conveying means for conveying said textile recording medium from said textile recording medium supply means to said textile recording medium collection means.

79. An ink jet textile printing apparatus according to claim 68, further comprising said ink jet recording means.

80. A printing apparatus according to claim 68, wherein when the ink dot is fixed to the recording medium, the ink dot cannot be removed by rinsing.

81. An ink jet textile printing apparatus according to claim 68, further comprising means for conveying the recording medium with respect to said recording means in a conveying direction.

82. An apparatus according to claim 68, wherein the average value of the equivalent circle diameter is two-thirds of or less than the average width of the fibers.

83. An apparatus according to claim 68, wherein the average value of the equivalent circle diameter is three-fifths of or less than the average width of the fibers.

84. A textile printing method, comprising the steps of:

providing a textile recording medium comprising a plurality of fibers, said fibers having an average fiber width;

providing an ink jet recording device comprising a print head, said print head comprising a plurality of discharge ports for discharging ink therefrom;

discharging selectively an ink having a coloring agent from said discharge ports so that a single discharge from a given said discharge port forms an associated ink dot having an area coverage ratio, said area coverage ratio being less than 100% of an area of a corresponding print picture element, and forming a plurality of ink dots with plural ink dots, before fixation, enclosing a central portion to which ink is not applied in an image area where all picture elements are applied with ink among images formed; and fixing said coloring agent onto said textile recording medium, wherein after said fixing step the central portion is covered with ink.

85. A textile printing method according to claim 84, wherein said controlling step is such that, following said fixing step, said associated ink dot has a diameter which is not more than three-fourths of the average fiber width.

86. A textile printing method according to claim 84, wherein after said fixing step, said area coverage ratio is between about 70%–100% of said area of said corresponding print picture element, and an area of each said ink dot is not more than 900% of said area of said picture element.

87. A printing method according to claim 86, wherein an area of a mono-colored ink dot is not more than 900% of the area of the picture element.

88. A printing method according to claim 84, wherein the area coverage ratio is 15–100%.

89. A printing method according to claim 84, wherein when the coloring agent is fixed to the recording medium, the coloring agent cannot be removed by rinsing.

90. A non-textile printing method, comprising the steps of:

providing a non-textile recording medium;

providing an ink jet recording device comprising a print head, said print head comprising a plurality of discharge ports for discharging an ink having a coloring agent therefrom;

discharging selectively said ink from said discharge ports so that a single discharge from a given said discharge port forms an associated ink dot having an area coverage ratio, said area coverage ratio being less than 100

% of an area of a corresponding print picture element, and forming a plurality of ink dots with plural ink dots, before fixation, enclosing a central portion to which ink is not applied in an image area where all picture elements are applied with ink among images formed; and fixing said coloring agent onto said non-textile recording medium, wherein after said fixing step the central portion is covered with ink.

91. A non-textile printing method according to claim 90, wherein said area coverage ratio is between about 70%–100% of said area of said corresponding print picture element, and an area of each said ink dot is not more than 900% of said area of said picture element.

92. A printing method according to claim 91, wherein an area of a mono-colored ink dot is not more than 900% of the area of the picture element.

93. A printing method according to claim 90, wherein when the coloring agent is fixed to the recording medium, the coloring agent cannot be removed by rinsing.

94. A process of printing on a textile medium, comprising the steps of:

providing an ink jet head; and printing on the textile medium by ejecting ink from the ink jet head onto the textile medium, wherein said printing step is carried out such that a plurality of ink dots are formed on the textile medium satisfying the condition that the average of equivalent circle diameters of the plurality of ink dots is three-fourths or less of the average width of the fibers making up the textile medium after a coloring matter contained in the ink is fixed to the textile medium, the equivalent circle diameter for each ink dot being the diameter of a circle having an area equal to the area of the ink dot.

95. A process according to claim 94, wherein when the coloring matter of the ink is fixed to the textile medium, the coloring matter cannot be removed by rinsing.

96. A process according to claim 94, wherein the average value of the equivalent circle diameter is two-thirds of or less than the average width of the fibers.

97. A process according to claim 94, wherein the average value of the equivalent circle diameter is three-fifths of or less than the average width of the fibers.

98. A textile printing apparatus adapted for printing onto a textile medium having fibers of a predetermined average width, comprising:

printing means, including an ink jet head, for printing on the textile medium by ejecting ink from said ink jet head; and control means for controlling said printing means, wherein said control means causes ink to be ejected from said printing means so that a plurality of ink dots are formed on the textile medium satisfying the condition that the average of equivalent circle diameters of the plurality of ink dots is three-fourths or less of the predetermined average width of fibers constituting the textile medium after a coloring matter contained in the ink is fixed to the textile medium, the equivalent circle diameter for each ink dot being the diameter of a circle having an area equal to the area of the ink dots.

99. An apparatus according to claim 98, wherein when the coloring matter of the ink is fixed to the textile medium, the coloring matter cannot be removed by rinsing.

100. An apparatus according to claim 98, wherein the average value of the equivalent circle diameter is two-thirds of or less than the predetermined average width of the fibers.

101. An apparatus according to claim 98, wherein the average value of the equivalent circle diameter is three-fifths of or less than the predetermined average width of the fibers.

102. An apparatus for forming ink jet printed products, the ink jet printed products being processed by a fixator that effects a fixing process after ink jet printing so that coloring matter contained in ink is fixed to a printing medium, said apparatus comprising:

a print head having discharge ports that discharge ink; and a controller that controls said print head such that in printing, an ink dot formed in a discharging operation through one of the discharge ports has an area coverage ratio of less than 100% relative to an area of a corresponding print picture element before the ink is fixed to the printing medium, said controller controlling said print head to form a plurality of ink dots on the printing medium, wherein before the fixing process, the plurality of ink dots enclose a central portion to which ink is not applied in an image area where all picture elements are applied with ink among images formed, such that the central portion is covered with ink after the fixing process.

103. An apparatus for forming ink jet printed products, the ink jet printed products being processed by a fixator that effects a fixing process after ink jet printing so that coloring matter contained in ink is fixed to a printing medium, said apparatus comprising:

a print head having discharge ports that discharge ink; and a controller that controls said printhead such that in printing the average value of an equivalent circle diameter of an ink dot formed at one time in a discharging operation through one of the discharge ports is three-fourths or less the average width of fibers constituting the printing medium after a coloring matter contained in the ink is fixed to the printing medium, the equivalent circle diameter for each ink dot being the diameter of a circle having an area equal to the area of the ink dot.

* * * * *

UNITED STATES PATENT AND TRADEMARK OFFICE

CERTIFICATE OF CORRECTION

PATENT NO. : 6,142,619
DATED : November 7, 2000
INVENTOR(S) : Miura et al.

It is certified that error appears in the above-identified patent and that said Letters Patent is hereby corrected as shown below:

Title page,
Item [56], References Cited, FOREIGN PATENT DOCUMENTS,
"2286250 11/1990 Japan" should read -- 2-286250 11/1990 Japan --.
"3046589 7/1991 Japan" should read -- 3-46589 7/1991 Japan --.
"623977 2/1994 Japan" should read -- 6-23977 2/1994 Japan --.
"5318721 12/1998 Japan" should read -- 5-318721 12/1993 Japan --.

Column 10,
Line 35, "trichtoracetate" should read -- trichloroacetate --.
Line 36, "becomes" should read -- becomes an --.

Column 11,
Line 33, "of" should read -- or --.

Column 13,
Line 10, "The" should begin a new paragraph.

Column 15,
Line 60, "value" should read -- values --.

Column 16,
Line 31, "time" should read -- time --.
Line 44, "the" should be deleted.
Line 45, "repects" should read -- respect --.

Column 17,
Lines 16 and 46, "the" should be deleted.
Lines 17 and 47, "respects" should read -- respect --.
Lines 35 and 56, "time" should read -- times --.

Column 18,
Line 20, "(100 magnifications)" should read -- (100 times magnification) --.
Line 50, "time" should read -- times --.

Column 20,
Line 47, "can not" should read -- cannot --.
Line 57, "achieved" should read -- achieved. --.
Line 65, "to the" should read -- for the ink to be --.

UNITED STATES PATENT AND TRADEMARK OFFICE

CERTIFICATE OF CORRECTION

PATENT NO. : 6,142,619
DATED : November 7, 2000
INVENTOR(S) : Miura et al.

It is certified that error appears in the above-identified patent and that said Letters Patent is hereby corrected as shown below:

Column 25,
Line 42, "Processed" should read -- processed --.

Column 27,
Line 3, "Processed" should read -- processed --.

Column 28,
Line 67, "100" should read -- 100 --.

Signed and Sealed this

Fifth Day of April, 2005

JON W. DUDAS
*Director of the United States Patent and Trademark Office*